US006786144B2

(12) United States Patent
Williams

(10) Patent No.: US 6,786,144 B2
(45) Date of Patent: Sep. 7, 2004

(54) WRINGER ROLLER SYSTEM

(75) Inventor: Thomas E. Williams, Oak Creek, WI (US)

(73) Assignee: New Gencoat, Inc., Sussex, WI (US)

( * ) Notice: Subject to any disclaimer, the term of this patent is extended or adjusted under 35 U.S.C. 154(b) by 0 days.

(21) Appl. No.: 10/157,692

(22) Filed: May 29, 2002

(65) Prior Publication Data

US 2002/0178936 A1 Dec. 5, 2002

Related U.S. Application Data

(60) Provisional application No. 60/294,550, filed on May 30, 2001.

(51) Int. Cl.[7] ..... B30B 3/04; D06F 45/00; B21B 31/00

(52) U.S. Cl. ..... 100/168; 100/176; 68/244; 72/237

(58) Field of Search ..... 100/176, 35, 155 R, 100/161, 162 R, 163 R, 163 A, 164, 165, 168, 169, 170; 72/238, 237, 239; 68/239, 241, 244, 245, 253 R, 256, 265, 275

(56) References Cited

U.S. PATENT DOCUMENTS

| | | | | | |
|---|---|---|---|---|---|
| 2,861,504 | A | * | 11/1958 | Kane | 100/99 |
| 3,702,557 | A | * | 11/1972 | Amend | 72/238 |
| 3,731,620 | A | * | 5/1973 | Klemmer | 101/23 |
| 3,754,426 | A | * | 8/1973 | Adair | 72/238 |
| 3,938,214 | A | | 2/1976 | Hodsden et al. | |
| 3,998,158 | A | | 12/1976 | Vertegaal | |
| 4,067,215 | A | | 1/1978 | Nakajima et al. | |
| 4,388,169 | A | | 6/1983 | Nagira et al. | |
| 4,557,130 | A | * | 12/1985 | Bond | 72/225 |
| 4,994,157 | A | | 2/1991 | Itoh et al. | |
| 5,079,939 | A | | 1/1992 | Shook | |
| 5,248,372 | A | | 9/1993 | McNamee | |
| 5,292,374 | A | | 3/1994 | Maresch et al. | |
| 5,412,966 | A | | 5/1995 | Neese et al. | |
| 5,460,565 | A | | 10/1995 | Perneczky | |
| 5,558,018 | A | * | 9/1996 | Leinonen | 100/170 |
| 5,803,984 | A | | 9/1998 | Lordo et al. | |
| 5,879,465 | A | | 3/1999 | McKevitt et al. | |
| 5,983,694 | A | * | 11/1999 | Woodrow et al. | 72/238 |
| 6,230,615 | B1 | * | 5/2001 | Zimmermann et al. | 100/38 |

* cited by examiner

*Primary Examiner*—Jimmy T Nguyen
(74) *Attorney, Agent, or Firm*—Foley & Lardner LLP

(57) ABSTRACT

A roller system includes a frame, an upper roller assembly, a lower roller assembly and an actuator. In one embodiment, the upper roller assembly includes a first rotatably supported cylindrical member. The lower roller assembly is movably supported by the frame below the upper roller assembly and includes a second rotatably supported cylindrical member. The actuator is configured to move the second cylindrical member between an elevated position and a lowered position. In another embodiment, the roller system includes a frame, at least one upper track, an upper roller assembly, at least one lower track and a lower roller assembly. The upper roller assembly includes a first rotatably supported cylindrical member extending along an upper axis. The upper roller assembly is supported by the upper track and moves along the upper axis between an operation position and a removed position. The lower roller assembly includes a second rotatably supported cylindrical member extending along a lower axis. The lower roller assembly is movably supported by the at least one lower track and moves along the lower axis between an operation position and a removed position.

44 Claims, 19 Drawing Sheets

FIG. 28
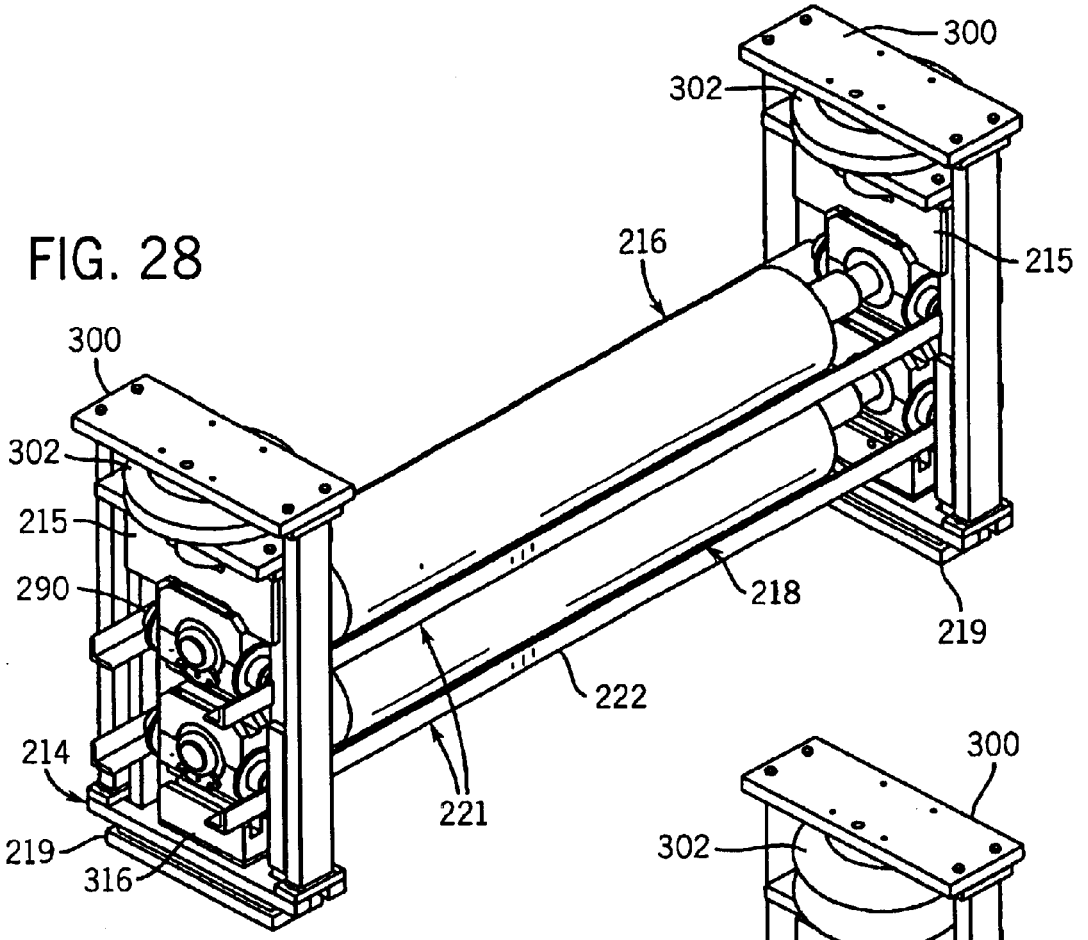
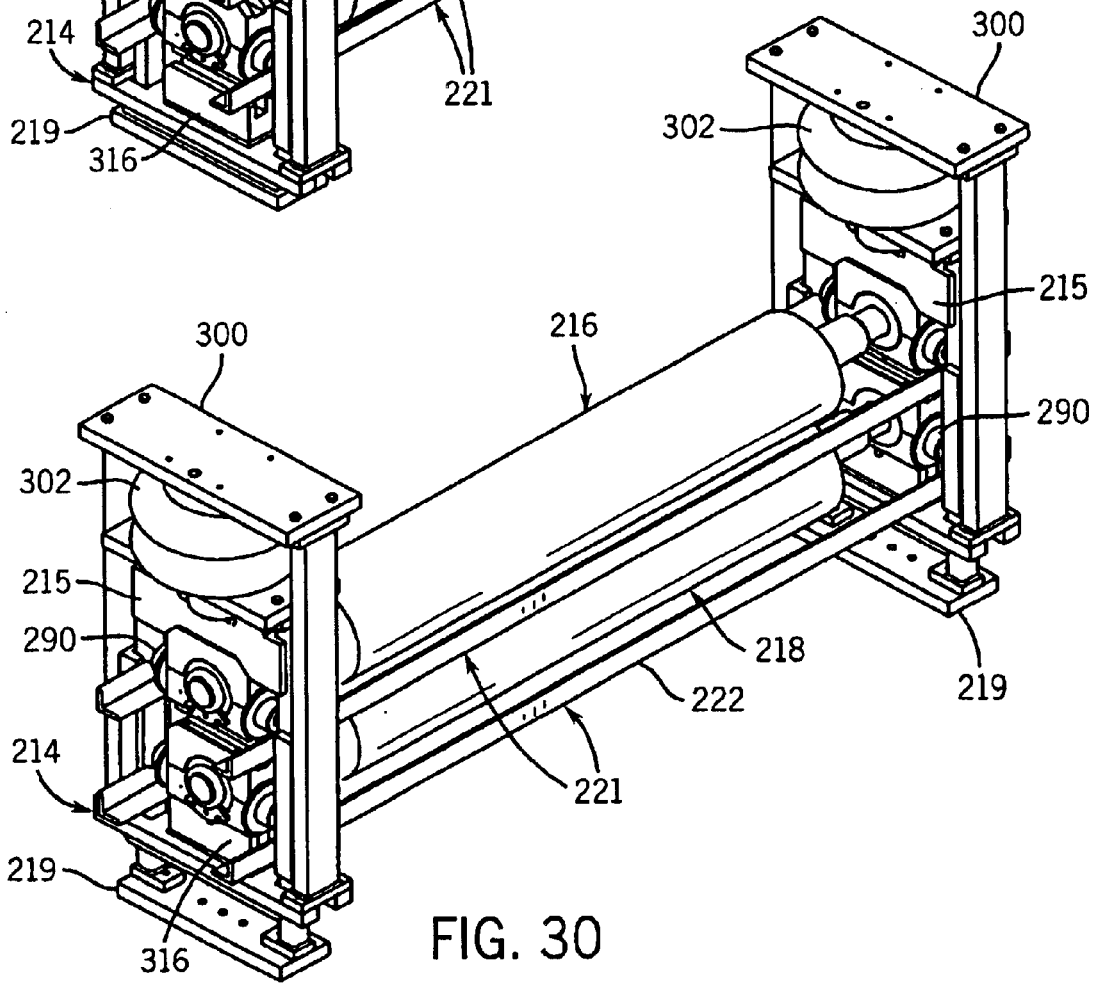
FIG. 30

WRINGER ROLLER SYSTEM

The present application claims priority under 35 U.S.C. §119(e) from U.S. Provisional Patent Application Serial. No. 60/294,550 entitled WRINGER ROLLER SYSTEM and filed on May 30, 2001 by Thomas E. Williams, the full disclosure of which is hereby incorporated by reference.

FIELD OF THE INVENTION

The present invention relates to systems which utilize a cylindrical roller to work upon a product or work piece. In particular, the present invention relates to a system utilizing a pair of opposing cylindrical roller members which cooperate to work on a work piece. Even more particular, the present invention relates to a wringer roller system having an easily removable cylindrical roller.

BACKGROUND OF THE INVENTION

Wringer roller systems are commonly employed to wring or remove chemicals, coatings, or moisture from strips of material. In the strip processing industry, strips of metallic or non-metallic material in web or strip form are frequently wetted for the purpose of rinsing and/or cleaning of residue by passing the web or strip through a plurality of tanks, vessels, or compartments. Such wringer rollers are employed between the tanks, vessels, or compartments to displace fluid off of the web or strip and to serve as a seal between adjacent tanks, vessels, or compartments.

Wringer rollers typically include a frame, a lower roller and an upper roller. The lower roller and the upper roller are supported by the frame in a spaced apart relationship so as to engage opposite sides of the strip passing therebetween. Typically, the lower roller is fixed to the frame, while the upper roller is raised and lowered relative to the strip by a pneumatic cylinder mounted to the top of the frame.

Unfortunately, when the supply of air pressure to the pneumatic cylinder fails, either due to a power failure, more often as system pressure is lost during down time over night or weekends, the weight of the upper roller often causes it to drift downward and come to rest on the lower roller. Contact of the upper rollers and the lower rollers for a prolonged period of time frequently causes the rollers to develop a flat spot in the area of contact. This frequently results less than adequate drawing of the strip and introduces vibration into the strip as the flat spots engage the strip.

The exterior surface of such rollers is typically formed from rubber or similar material. Over time, the rubber wears and breaks down as a result of its contact with the strip and the sometimes corrosive residues. As a result, both the upper roller and the lower roller need to be periodically cleaned or replaced.

Unfortunately, with conventional wringer roller systems, removal and replacement of the upper and lower rollers is extremely difficult and time consuming. The presence of the metallic or non-metallic strip or web above the lower roller precludes the vertical removal of the lower roller without breaking or separating the strip. As a result, the lower roller must be removed while extending beneath the strip. Typically, the upper and lower rollers are each mounted to the frame such that removal and replacement of the upper and lower rollers requires that the frame itself be partially disassembled using tools. Once disassembled from the frame, the rollers are lifted or otherwise separated from the frame. This process is both tedious and time consuming. The time required to remove and later replace the upper and lower rollers is even further exacerbated due to the crowded conditions and limited space between the wringer roller system and the adjacent rinse tanks. Making such removal and replacement even more difficult, such upper and lower rollers are extremely large and frequently weigh thousands of pounds. This tedious and time consuming process often results in the manufacturing line being temporarily shut down for unacceptable and costly periods of time.

SUMMARY OF THE INVENTION

According to one embodiment of the present invention, a roller system includes a frame, an upper roller assembly, a lower roller assembly and an actuator. The upper roller assembly is supported by the frame and includes a first rotatably supported cylindrical member. The lower roller assembly is movably supported by the frame below the upper roller assembly and includes a second rotatably supported cylindrical member. The actuator is configured to move the second cylindrical member between an elevated position and a lowered position.

According to another embodiment of the present invention, a roller system includes a frame, an upper roller assembly including a first rotatably supported cylindrical member extending along an upper axis and a lower roller assembly including a second rotatably supported cylindrical member extending along a lower axis. The upper roller assembly moves along the upper axis between an operation position and a removed position. The lower roller assembly moves along the lower axis between an operation position and a removed position.

According to yet another embodiment, a support and actuation system is provided for use with an upper roller assembly having a first rotatably supported cylindrical member and a lower roller assembly having a second rotatably supported cylindrical member. The support and actuation system includes a frame extending along an axis, at least one first interface coupled to the frame and an actuator. The at least one first interface is configured to movably support one of the upper roller assembly and the lower roller assembly along the axis. The actuator is coupled to the frame and is configured to move at least one of the upper roller assembly and the lower roller assembly in a vertical direction.

According to yet another alternative embodiment, a roller assembly is provided for use with a roller system having at least one first interface. The roller assembly includes a first bearing block, a second bearing block, a cylindrical member rotatably supported between the first bearing block and the second bearing block for rotation about an axis, at least one second interface coupled to the first bearing block and the second bearing block the at least one second interface adapted to cooperate with the at least one first interface to facilitate movement of the roller assembly along the other track.

According to yet another alternative embodiment, a roller system includes a frame, an upper roller assembly having a first rotatably supported cylindrical member extending along an upper axis, a lower roller assembly having a second rotatably supported cylindrical member extending along a lower axis and means for moving at least one of the upper roller assembly and the lower roller assembly along the upper axis and the lower axis, respectively, between an operation position and a removed position.

According to yet another alternative embodiment, a roller system includes a support and actuation system and at least one roller assembly. The support and actuation system includes a frame, at least first interface coupled to the frame and an actuator. The at least one roller assembly includes a first bearing block, a second bearing block, a cylindrical member extending along an axis and rotatably supported between the first bearing block and the second bearing block, at least one second interface coupled to the first bearing block and the second bearing block to facilitate movement of the at least one roller assembly along the axis.

BRIEF DESCRIPTION OF THE DRAWINGS

FIG. 28 is a perspective view of the roller system of FIG. 19 illustrating the upper roller assembly and the lower roller assembly loaded into the frame and in a lowered position while with a stop of the system in a raised position.

FIG. 30 is a perspective view of the roller system of FIG. 19 illustrating the upper roller assembly and the lower roller assembly in a raised position and illustrating a stop in a lower position.

DETAILED DESCRIPTION OF THE PREFERRED EMBODIMENTS

Roller System 10

Figure 1:
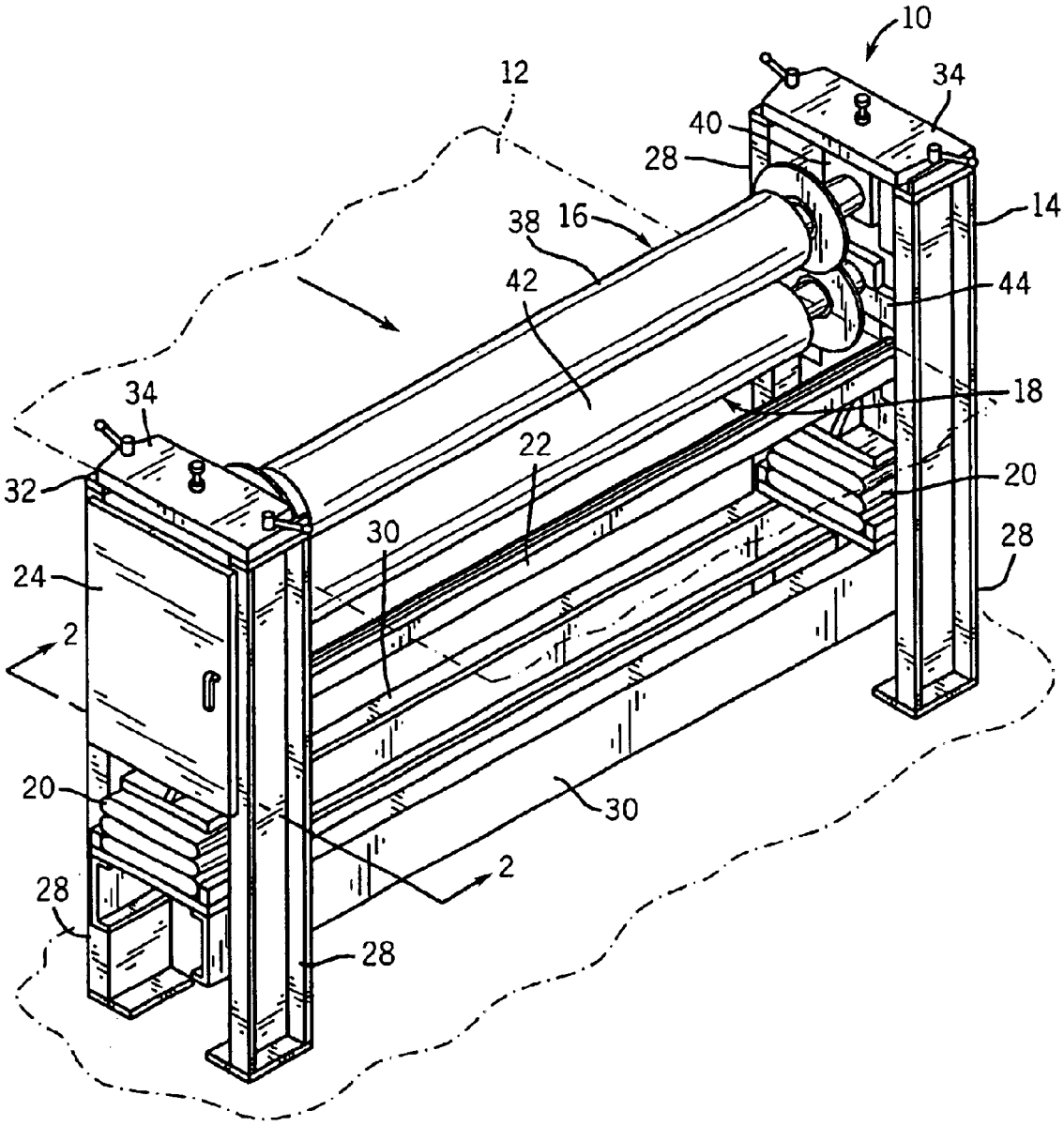
FIG. 1 is a perspective view of a first illustrated embodiment of the roller system of the present invention.

FIG. 1 is a perspective view of a wringer roller system 10 employed adjacent at least one rinse station (not shown) and in engagement with a metallic or non-metallic material in web or strip form product 12 (shown as a strip). System 10 generally includes frame 14, upper roller assembly 16, lower roller assembly 18, actuators 20, interfaces provided by rails 22, and door 24. Frame 14 generally comprises a structure located at least at opposite axial ends of upper roller assembly 16 and lower roller assembly 18 so as to support roller assemblies 16 and 18. In the exemplary embodiment, frame 14 is generally formed from two sets of spaced leg 28 joined together by cross beams 30. Each of the pair of legs 28 forms a top opening 32 covered by cover 34 and an end opening 35 (shown in FIG. 7) between legs 28 covered by door 24. Opening 32 permits upper roller assembly 16 to be separated from frame 14 while the end openings 35 covered by door 24 enable the lower roller assembly 18 to be separated from frame 14. As will be appreciated, frame 14 may have a variety of alternative structural configurations so as to support axial ends of roller assemblies 16, 18.

Upper roller assembly 16 and lower roller assembly 18 cooperate to remove excess unwanted fluid, residue or other material from above and below strip 12. Roller assemblies 16, 18 further form a seal between adjacent rinsing stations. Roller assembly 16 generally includes an elongate cylindrical member 38 rotatably supported by bearing assemblies 40 (only one of which is shown in FIG. 1) at its opposite axial ends. In the exemplary embodiment, cylindrical member 42 has an outer cylindrical surface including a resilient material such as an elastomer, like rubber. Roller assembly 16 is generally supported by frame 14 above lower roller assembly 18.

Lower roller assembly 18 is movably supported by frame 14 below upper roller assembly 16 and generally includes elongate cylindrical member 42 and opposite bearing assemblies 44 (only one is shown in FIG. 1) rotatably supporting member 42. Cylindrical member 42 has an outer cylindrical surface preferably including a resilient material such as an elastomer, like rubber. Depending upon the particular application, the outer cylindrical surface of member 42, as well as member 38, may include a variety of other materials depending upon the specific purpose and function of system 10. In alternative applications, one or both of members 38 or 42 may be rotatably driven.

Actuators 20 are generally located proximate to each axial end of assemblies 16, 18 and are configured to raise and lower assembly 18. In particular, each actuator 20 is configured to move lower roller assembly 18 between an elevated position in which cylindrical member 42 is spaced from cylindrical member 38 so as to cooperate with cylindrical member 38 to remove or squeegee fluids or other materials from strip 12 passing therebetween and a lowered position. In the lowered position, lower assembly 18 is preferably rested upon rails 22 at a location spaced from cylindrical member 38 and strip 12. Although actuators 20 are illustrated as being supported by frame 14 above cross bars 30, actuators 20 being supported by frame 14 by various other structures or may be supported on the ground or other supporting surface independent of frame 14.

Rails 22 extend between opposite ends of frame 14 below lower roller assembly 18 and above actuators 20. Rails 22 serve as interfaces for interacting with the corresponding interfaces coupled to lower roller assembly 18. As used herein, the term "interface"means any one of two components which engage or interact with one another to facilitate relative movement between the two elements. Such interaction serves to support one element relative to another element. Such interaction may also serve to guide or align movement of one element relative to another element. Examples of interfaces include rails, wheels, low friction surfaces, bearings such as air bearings, ball bearings, bushings and the like, grooves or channels, tongues, and other interengaging or interacting mechanisms presently known or future developed.

As will be described in greater detail hereafter, rails 22 serve as a support upon which lower roller assembly 18 rests when assembly 18 has been lowered to the lowered position. Rails 22 also serve as a track for guiding movement of roller assembly 18 through the end opening 35 covered by door 24 to enable lower roller assembly 18 to be removed for cleaning, repair or replacement. As a result, when cylindrical member 42 of lower roller assembly 18 needs cleaning, repair or replacement, actuators 20 lower assembly 18 onto rails 22. Door 24 is then opened allowing assembly 18 to be moved through the end opening 35. This process requires little space and is very efficient.

Figure 2:
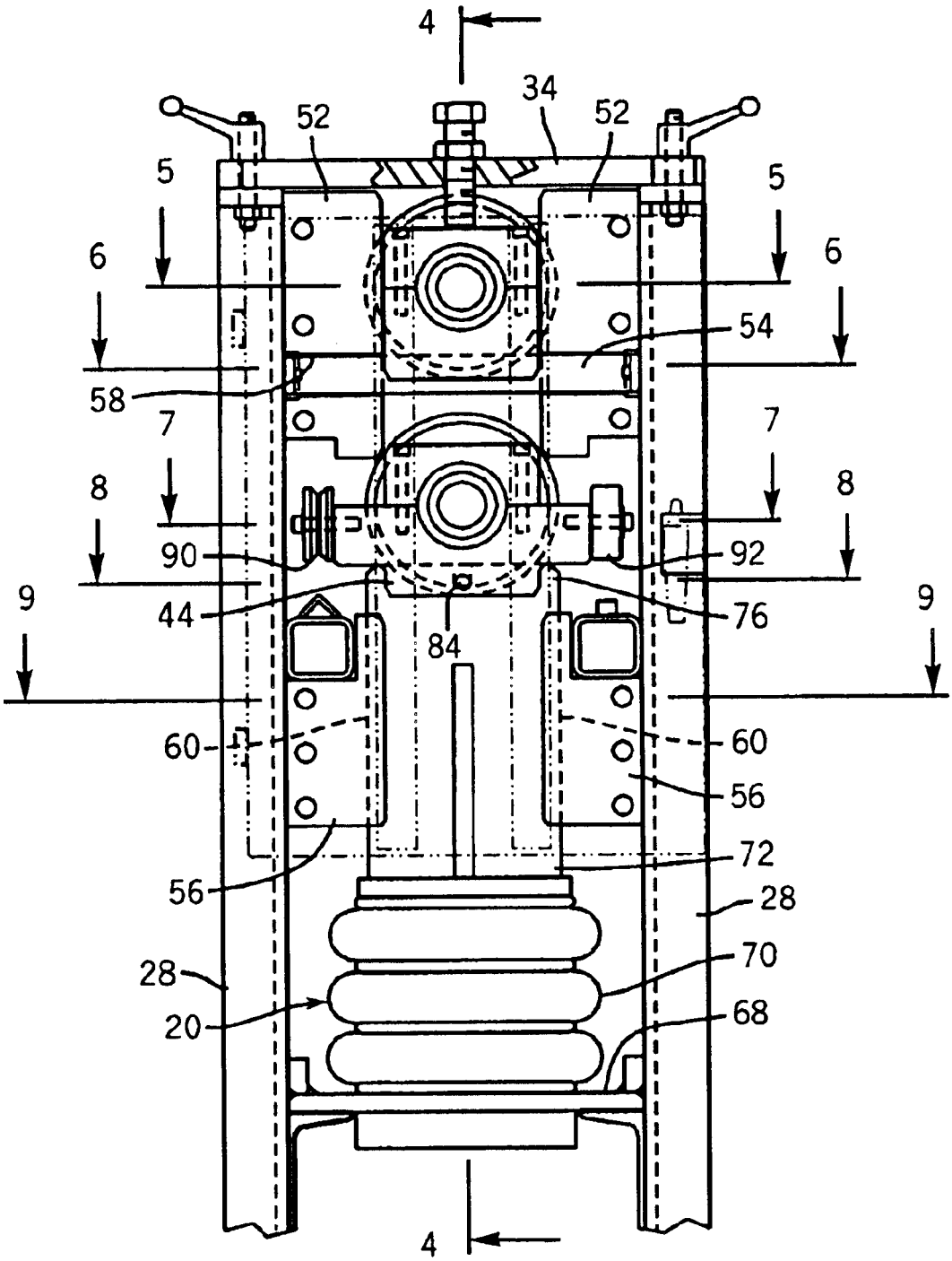
FIG. 2 is a fragmentary elevational view of the roller system of FIG. 1 illustrating a lower roller assembly in a raised position.
Figure 3:
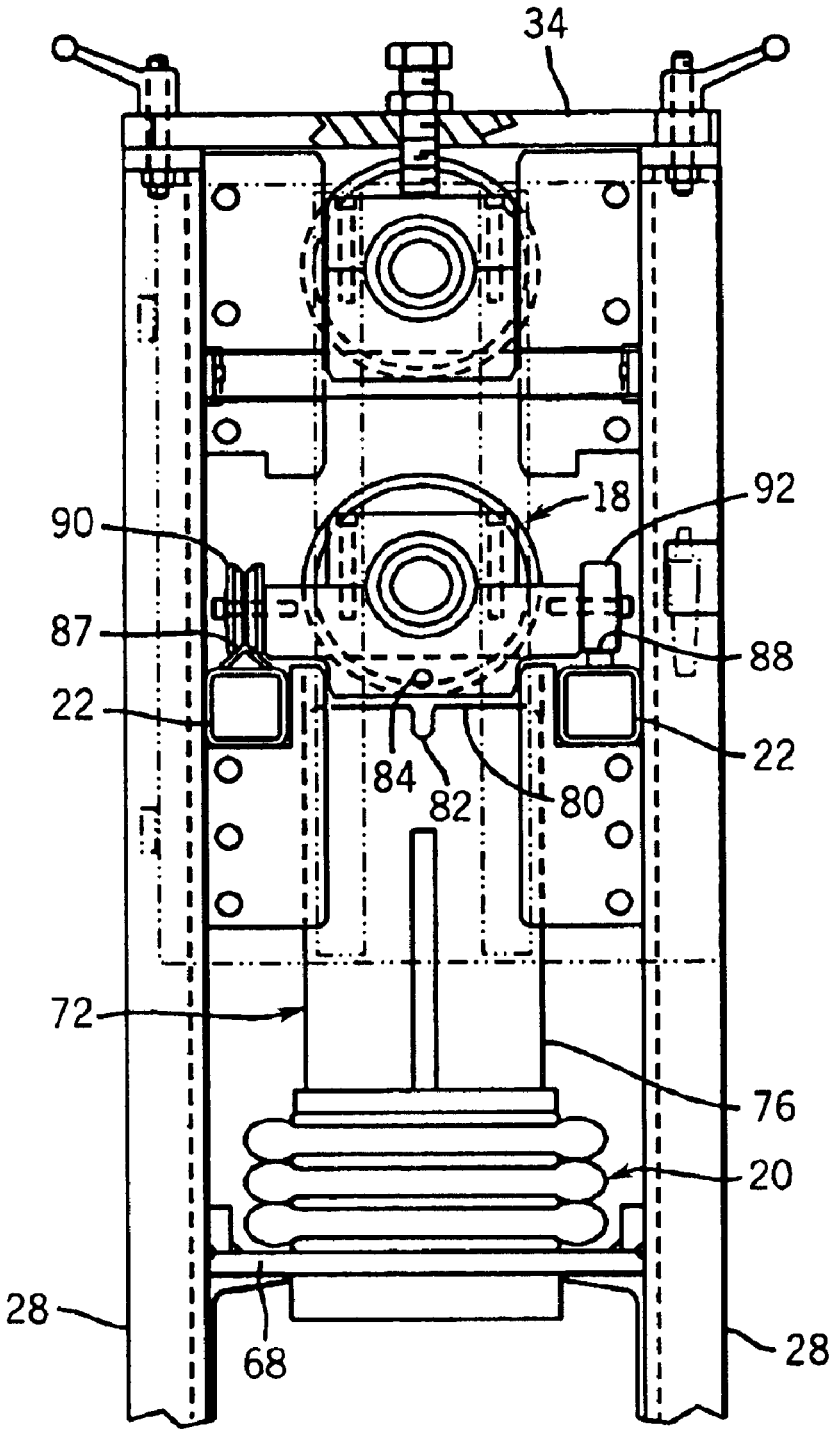
FIG. 3 illustrates a roller system of FIG. 2 with the lower roller assembly in a lowered position.
Figure 4:
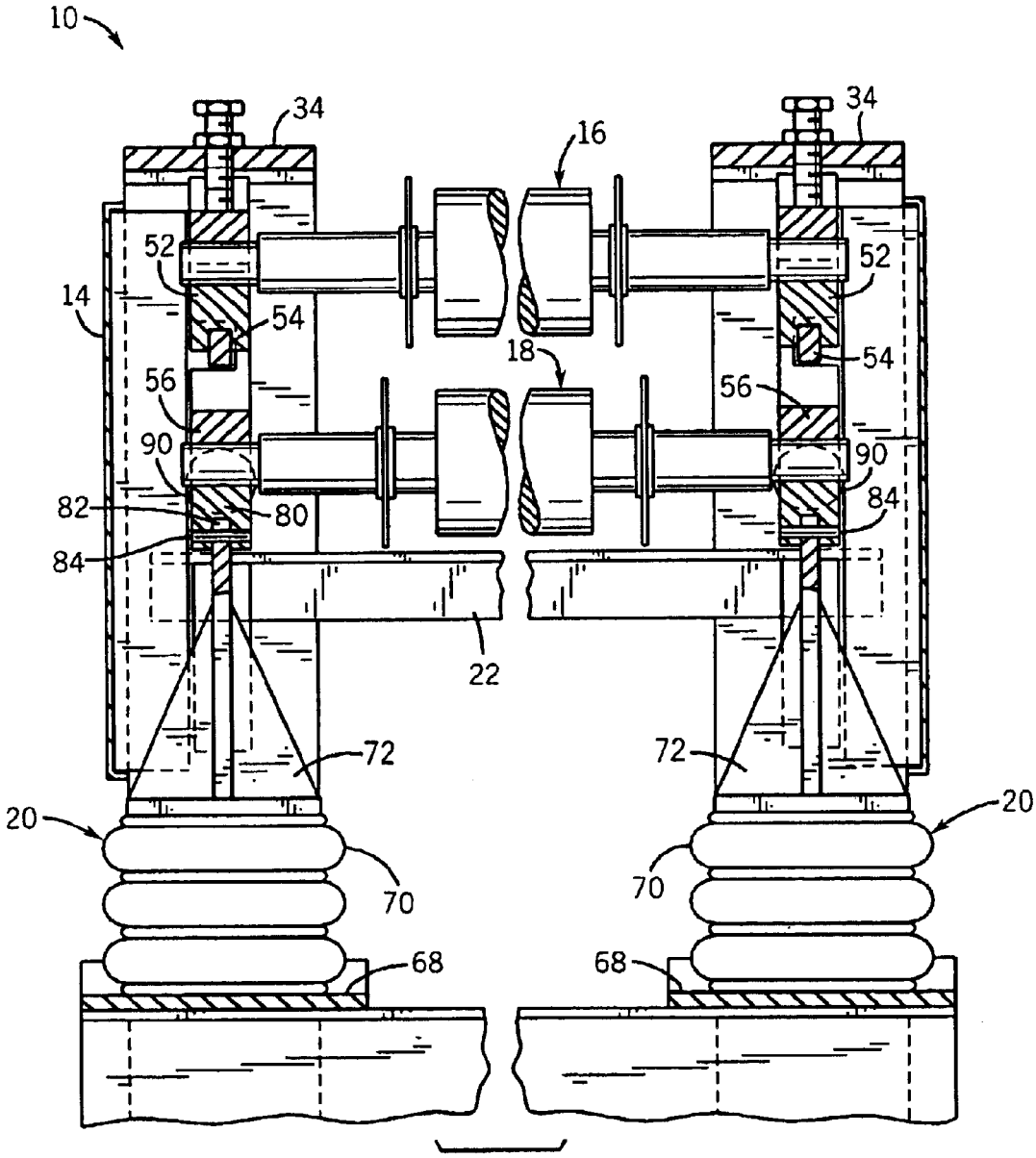
FIG. 4 is a fragmentary sectional view of the roller system of FIG. 2 taken along line 4—4.
Figure 5:
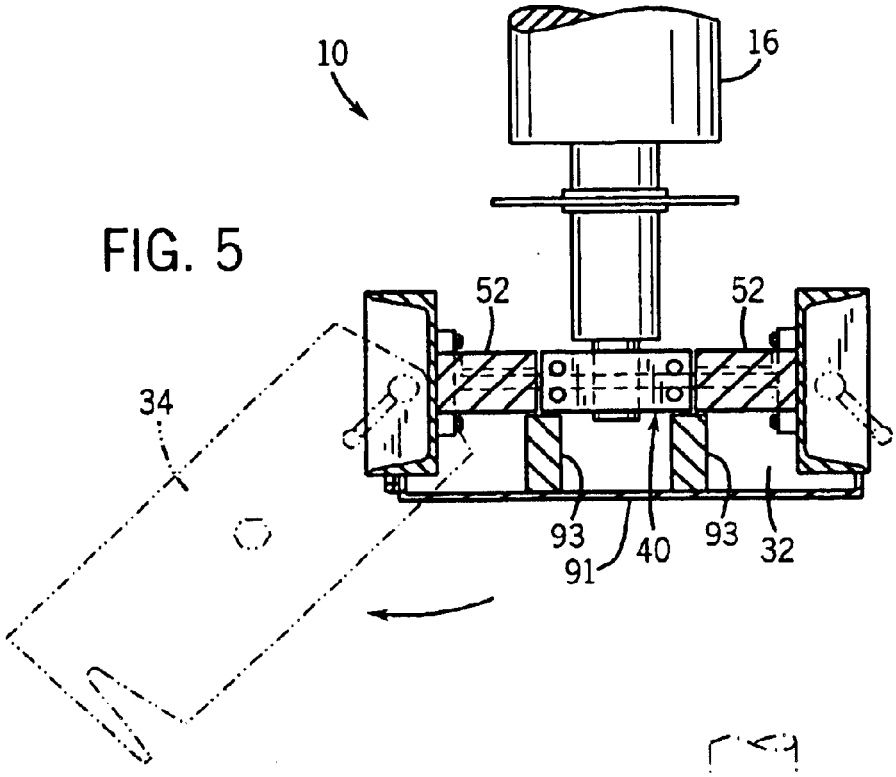
FIG. 5 is a sectional view of the roller system of FIG. 2 taken along line 5—5.
Figure 12A:
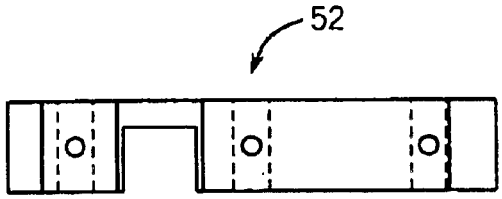
FIGS. 12A, 12B and 12C are orthogonal views of an upper guide of the system of FIG. 1.
Figure 12C:
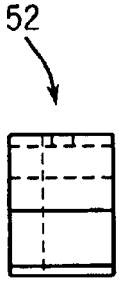
Figure 12B:
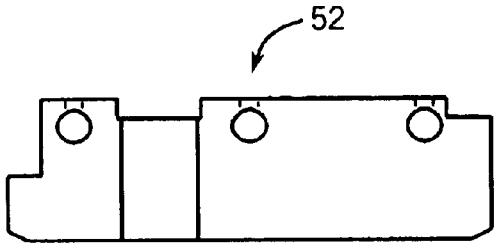
Figure 13A:
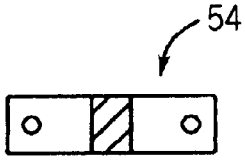
FIGS. 13A, 13B, 13C and 13D are orthogonal views of the tie bar of the system of FIG. 1.
Figure 13B:
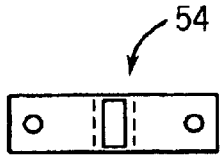
Figure 13C:
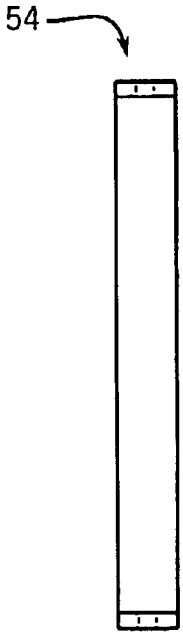
Figure 13D:
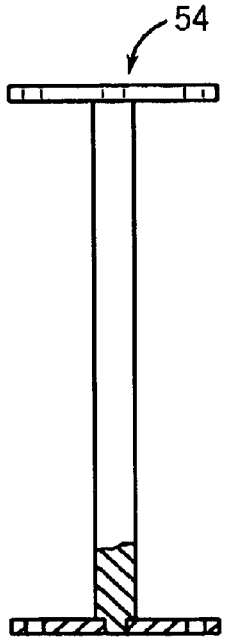
Figure 18A:
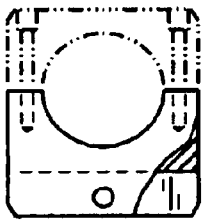
FIGS. 18A, 18B and 18C are orthogonal views of a roller assembly of the system of FIG. 1.
Figure 18B:
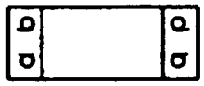
Figure 18C:
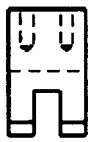

FIGS. 2–9 illustrate system 10 in greater detail. Each of FIGS. 2 and 4–9 illustrate system 10 when lower roller assembly 18 is in an elevated position such that cylindrical member 42 is located proximate to cylindrical member 38 to cooperatively engage strip 12. FIG. 3 illustrates system 10 when lower roller assembly 18 is in the lowered position such that assembly 18 rests upon rails 22. Movement between the raised and lowered position is guided by frame 14. In addition, frame 14 supports upper roller assembly 16 in a generally fixed relation. As best shown by FIG. 2, frame 14 additionally includes upper guides 52, tie bar 54 and lower guides 56. Upper guides 52 generally comprise structures such as plates mounted to legs 28 on opposite sides of bearing assemblies 40 of upper roller assembly 16. Three orthogonal views of an individual guide 52 are shown in FIG. 12. Guides 52 maintain upper roller assembly 16 in a fixed orientation relative to frame 14 by abutting opposite sides of bearing assembly 40 as shown in FIG. 5. (FIG. 18 illustrates three orthogonal views of an upper half and a lower half of bearing assembly 40.) In the elevated position, the upper edge of bearing assembly 44 is keyed or partially received within and between guides 52 of frame 14. As a result, undesirable lateral movement of roller assembly 18 is further inhibited. Each of guides 52 includes an opening 58 which receives tie bar 54.

Figure 6:
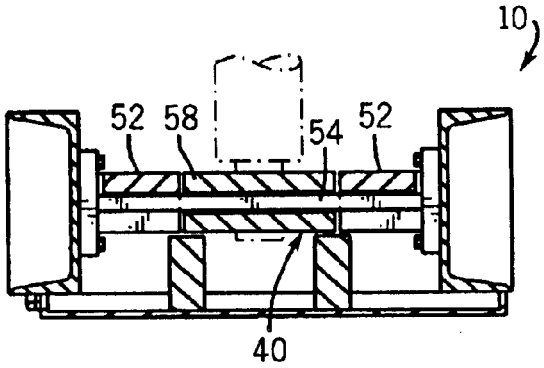
FIG. 6 is a fragmentary sectional view of the roller system of FIG. 2 taken along line 6—6.

Tie bar 54 comprises an elongate structure extending between legs 28 below bearing assembly 40 so as to support bearing assembly 40. Four orthogonal views of an individual tie bar 54 are shown in FIG. 13. As shown by FIG. 2, tie bar 54 is mounted to each of legs 28 and extends through opening 58. As shown by FIG. 6, tie bar 54 is received within a lower slot or channel 58 formed within a lower end of bearing assembly 40. As a result, this relationship retains upper roller assembly 16 in an axial direction. Alternatively, tie bar 54 could include a groove while the lower end of bearing assembly 40 includes a corresponding tongue. In further alternative embodiments, upper cylinder assembly 16 may be secured in the axial direction by other structures and mechanisms. The aforementioned structures enable cover 34 to be removed and enable upper cylinder assembly 16 to be lifted from between legs 28 through top opening 32 for cleaning, repair or replacement. Moreover, in alternative applications, tie bar 54 may be integrally formed as part of a single unitary body with guides 52 or other means may be employed to support upper roller assembly 16.

Figure 8:
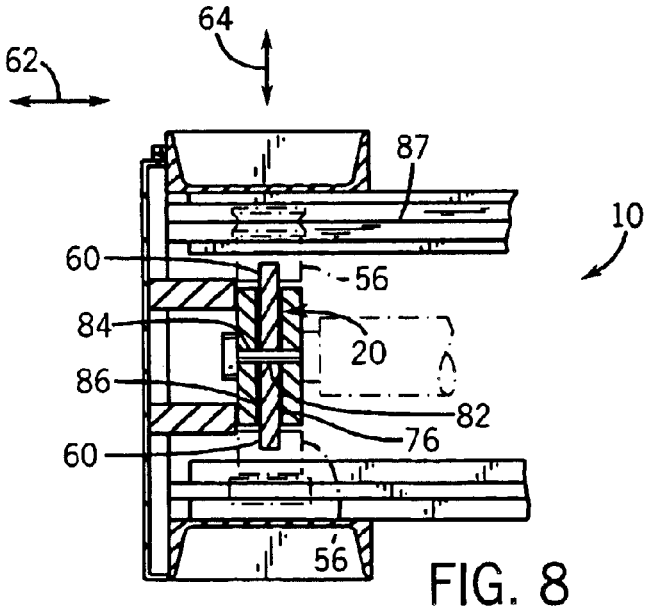
FIG. 8 is a fragmentary sectional view of the roller system of FIG. 2 taken along line 8—8.
Figure 14A:
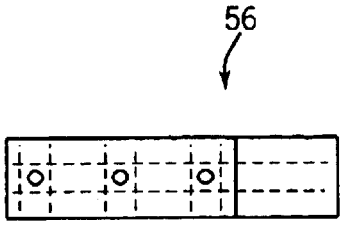
FIGS. 14A, 14B and 14C are orthogonal views of a guide of the system of FIG. 1.
Figure 14B:
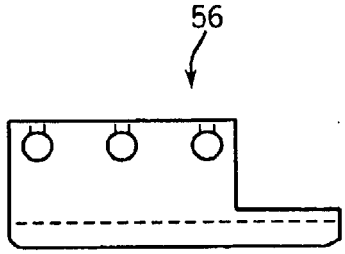
Figure 14C:
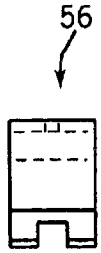

Guides 56 comprise structures, such as plates, mounted to legs 28 and configured to guide movement of actuator 20. In the exemplary embodiment, guide 56 is notched around rail 22 to provide a longer bearing surface for actuator 20. Three orthogonal views of an exemplary individual guide 56 is shown in FIG. 14. As shown by FIG. 8, guides 56 extend opposite one another on opposite sides of actuator 20 and include opposing grooves 60. Grooves 60 slidably receive an upper portion of actuator 20 when actuator 20 is lifting or lowering lower roller assembly 18. Thus, guides 56 prevent undesirable axial movement of actuator 20 and assembly 18 in the direction indicated by arrows 62 as well as undesirable movement in the direction indicated by arrows 64. In alternative embodiments, such restraint of movement may be achieved by a variety of alternative structures and mechanisms. For example, actuator 20 may alternatively include a groove which mates with a tongue provided on guide 56. A variety of other structures such as tracks, ball bearing assemblies and the like may be employed for guided movement of actuator 20 and lower roller assembly 18.

Figure 9:
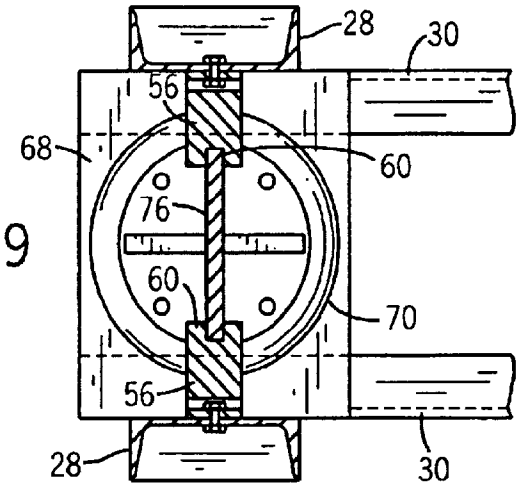
FIG. 9 is a fragmentary sectional view of the roller system of FIG. 2 taken along line 9—9.

FIGS. 2, 3 and 9 illustrate actuator 20 in greater detail. Actuator 20 generally includes base 68, bellows 70 and lift bracket 72. Base 68 extends between legs 28 and supports the remainder of actuator 20. As noted above, although less desirable, base 68 may be omitted such that the remainder of actuator 20 is mounted upon the ground or other support surface. In yet other alternative embodiments, the remaining portions of actuator 20 may be directly secured to legs 28 depending upon the exact type of actuator utilized.

Bellows 70 comprises an air inflatable bellows supported by base 68 and coupled to bracket 72. Bellows 70 preferably comprise an AIR STROKE 313 provided by Firestone Industrial Products Company. Various other bellows may also be employed. Bellows 70 is selectively inflatable to raise and lower bracket 72 so as to also raise and lower assembly 18. Because actuator 20 includes bellows 70, bellows 70 generates large forces upon being inflated. At the same time, bellows 70 is capable of absorbing shock or other forces incurred by actuator 20 and lower roller assembly 18. For example, joints or folds between ends of adjacent strips of metallic or non-metallic material in web or strip form passing between cylindrical members 38 and 42 will have an enlarged thickness imposing a force upon lower roller assembly 18. In such a circumstance, bellows 70 more easily functions as a shock absorber as compared to other linear actuators employing piston cylinder assemblies. Moreover, because bellows 70 is generally formed from elastomeric material or polymeric material, bellows 70 is extremely corrosion resistant. Although less desirable, bellows 70 may be replaced with other conventionally known or future developed linear actuators. For example, bellows 70 may alternatively be replaced with hydraulic or pneumatic cylinder-piston assemblies, electric solenoid actuators or various other mechanical actuators configured to selectively raise or lower roller assembly 18.

Figure 15A:
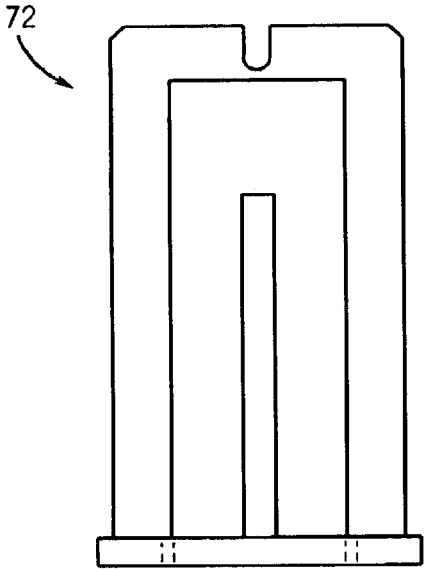
FIGS. 15A, 15B and 15C are orthogonal views of a lift bracket of the system of FIG. 1.
Figure 15B:
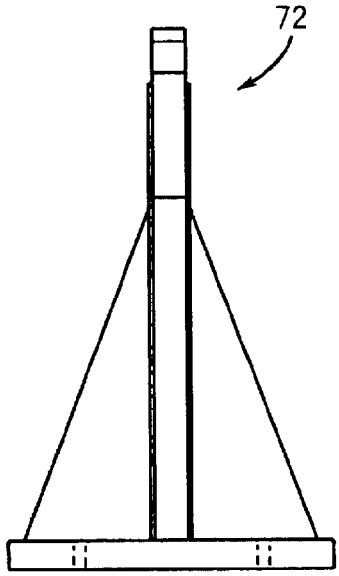
Figure 15C:
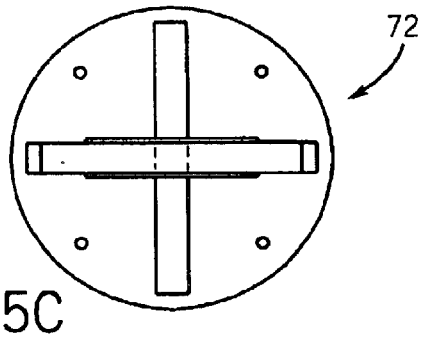
Figure 16A:
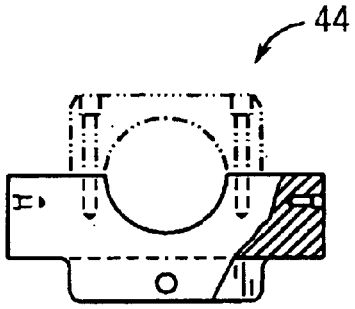
FIGS. 16A, 16B and 16C are orthogonal views of a first portion of a bearing assembly of the system of FIG. 1.
Figure 16B:
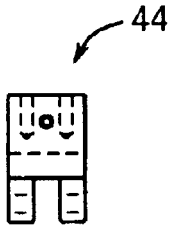
Figure 16C:
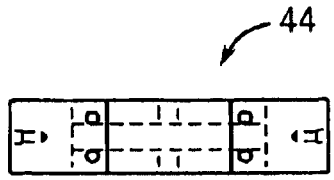
Figure 17A:
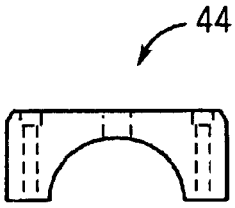
FIGS. 17A, 17B and 17C are orthogonal views of a second portion of the bearing assembly of FIGS. 16A, 16B and 16C.
Figure 17B:
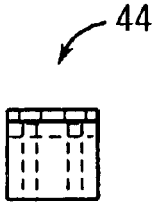
Figure 17C:
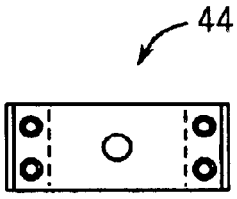

Bracket 72 is coupled to bellows 70 and is configured to engage bearing assembly 44 of lower roller assembly 18. Three orthogonal views of an exemplary bracket 72 are shown in FIG. 15. As shown in FIG. 9, bracket 72 includes a plate 76 having opposite edges which are slidably received within grooves 60 of opposite guides 56. As shown by FIG. 3, plate 76 includes an upper edge 80 and a notch 82. As best shown by FIGS. 2, 4 and 8, when bracket 72 is lifted by bellows 70 into engagement with lower roller assembly 18, edge 80 is received within a lower end of bearing assembly 44 and notch 82 receives a cross pin 84 secured to bearing assembly 44. FIGS. 16 and 17 each illustrate three orthogonal views of the upper and lower halves of bearing assembly 44. As shown by FIG. 8, the lower half of bearing assembly 44 includes a groove 86 which receives an upper portion of plate 76 when bracket 72 is engaged with bearing assembly 44 and lower roller assembly 18. At the same time, notch 82 receives pin 84. As a result, this interlocking of plate 76 with lower bearing assembly 44 and lower roller assembly 18 restrains relative movement of bracket 72 and lower roller assembly 18 in the directions indicated by arrows 62 and 64. Vertical movement of lower roller assembly 18 relative to bracket 72 is inhibited by the mere weight of lower roller assembly 18. Thus, lower roller assembly 18 is releasably affixed to actuator 20 and secured to actuator 20 against movement in all directions as actuator 20 moves assembly 18. At the same time, actuator 20 may be lowered until assembly 18 rests upon rails 22 and further lowered to separate actuator 20 from assembly 18. This separation is achieved without tools or time-consuming procedures.

As discussed above, rails 22 serve as both supports for lower roller assembly 18 and as tracks for lower roller assembly 18. FIGS. 2 and 3 best illustrate this functioning of rails 22. As shown in FIGS. 2 and 3, one of rails 22 includes alignment surface 87 and the other of rails 22 includes a bearing surface 88. Lower bearing assembly 44 additionally includes interfaces 89 in the form of a V-grooved wheel 90 and a flat-faced wheel 92. Surface 87 generally comprises a V-shaped surface configured to engage and be partially received within a corresponding V-shaped groove in wheel 90 when lower roller assembly 18 is resting upon rails 22. This interaction between surface 87 and wheel 90 enables rails 22 to serve as a track to align and guide movement of assembly 18 in a direction parallel to the rotational axis of cylindrical member 42 when assembly 18 is being removed or reinserted.

Bearing surface 88 comprises a generally flat face upon which the flat surface of wheel 92 rolls. Although only one of rails 22 is illustrated as including an alignment surface 87 opposite a V-shaped wheel 90, both of such rails 22 may be provided with such a tracking mechanism. Moreover, various other tracking mechanisms may also be employed. For example, one or both of rails 22 may alternatively include a channel in which grooved or ungrooved wheels move along rails 22. In alternative embodiments, the wheels themselves may comprise projections or tongues configured to engage grooves formed within rails 22. In yet alternative embodiments, wheels 90 and 92 may be replaced with other low friction interfaces which facilitate movement of assembly 18 along rails 22. Such interfaces may comprise low friction interactive interfacing coatings or surfaces. Furthermore, in alternative embodiments where other track means are provided for aligning or guiding movement of assembly 18 along rails 22, rails 22 may alternatively merely serve as a support for movement of assembly 18. In alternative embodiments, lower roller assembly 18 may be provided with two elongate rails which interact with corresponding wheels or other interfaces coupled to both halves of frame 14.

Figure 7:
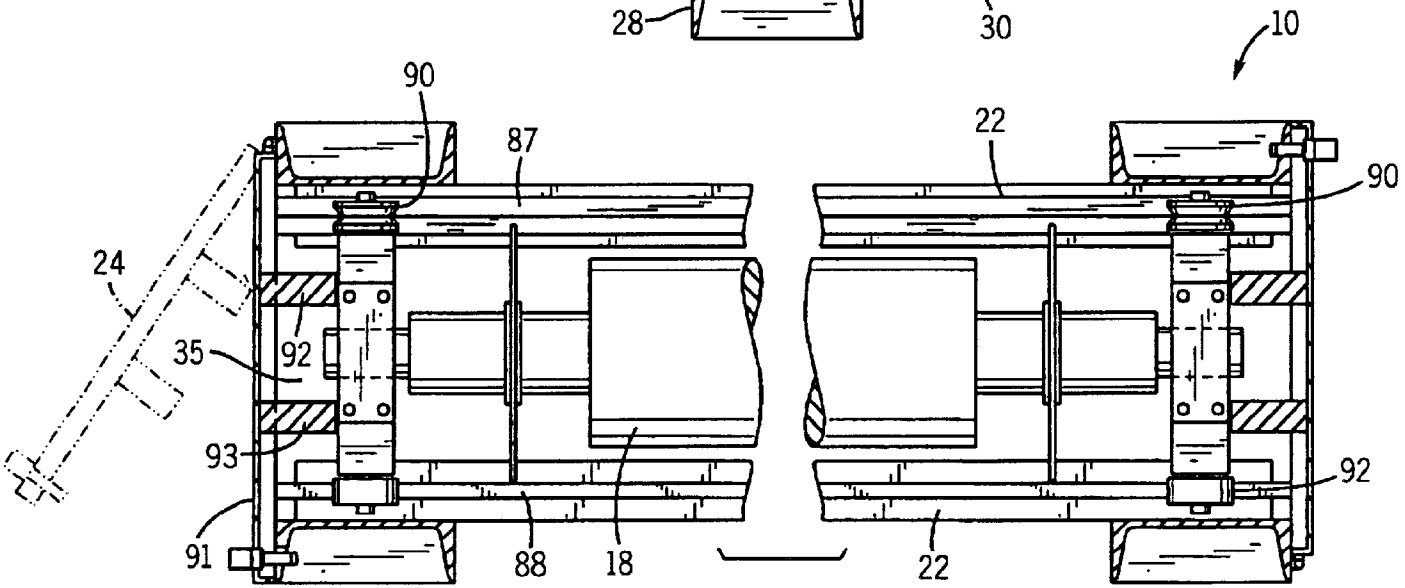
FIG. 7 is a fragmentary sectional view of the roller system of FIG. 2 taken along line 7—7.

FIG. 7 illustrates door 24 in greater detail. As shown in FIG. 7, door 24 moves between a closed position and an open position at an axial end of assemblies 16, 18. Door 24 includes a cover 91 and a pair of projecting guides 93. Guides 93 are spaced from one another and are configured so as to closely abut bearing assemblies 40 and 44 to further restrain axial movement of assembly 16, 18. Each of guides 93 preferably has a vertical length sufficient so as to closely abut bearing assembly 44 of assembly 18 as bearing assembly 44 moves between the elevated position and the lowered position discussed above. In alternative embodiments, guides 93 may be omitted or alternative structures may be employed.

Figures 10, 11:
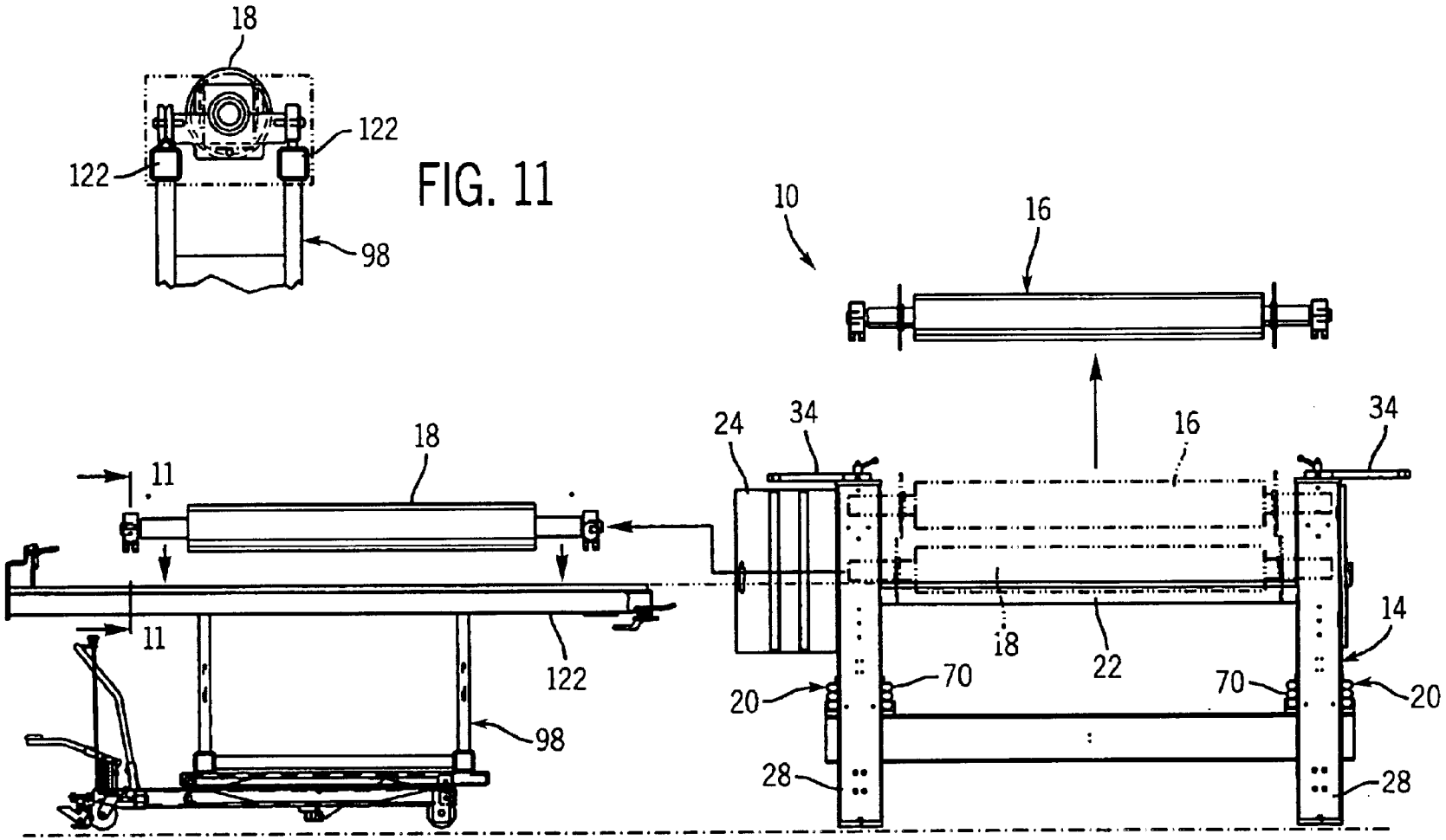
FIG. 10 is a side elevational view of the roller system of FIG. 1 based on a cart, illustrating the removal of upper and lower roller assemblies of the roller system.
FIG. 11 is a fragmentary sectional view of the cart shown in FIG. 10 taken along line 11—11.

FIGS. 10 and 11 illustrate the removal of bearing assemblies 16, 18 from system 10 utilizing cart 98. In operation, bellows 70 of actuator 20 at each end of frame 14 is deflated such that assembly 18 is lowered onto rails 22 and such that actuator 20 disengages lower assembly 18. Door 24 is opened and cart 98 is positioned adjacent to and in alignment with rails 22. Cart 98 includes a pair of similarly configured rails 122 which preferably mate or interconnect with ends of rails 22. Assembly 18 is thereafter moved along rails 22 onto rails 122. To remove roller assembly 16, covers 34 are dislodged as shown in FIG. 5, and assembly 16 is simply lifted from between legs 28 of frame 14. As a result, cylindrical members 38, 42 of roller assembly 16, 18, respectively, may be easily cleaned, repaired or replaced. This procedure can be achieved substantially without tools, in a crowded environment and in little time.

Roller System 210

Figure 19:
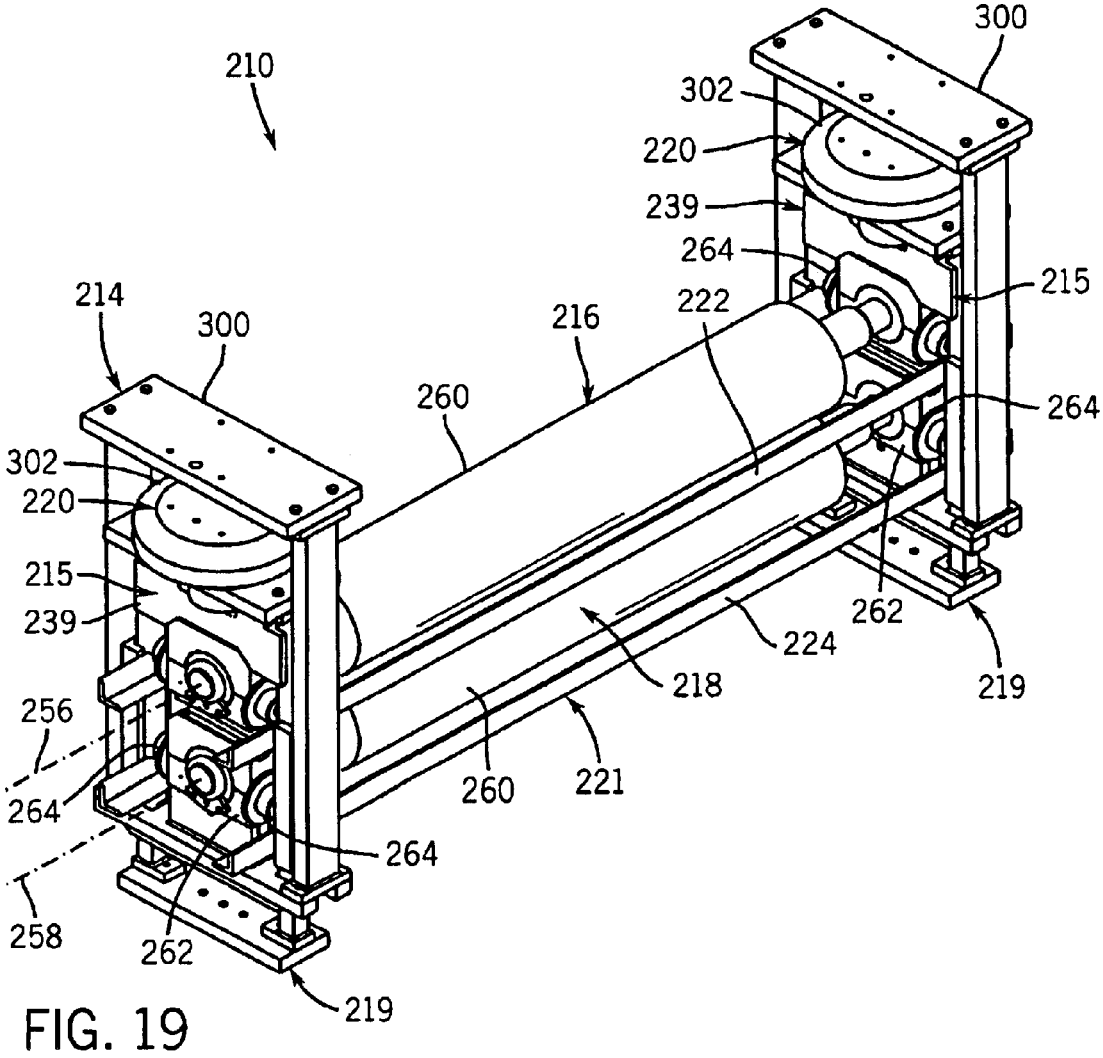
FIG. 19 is a perspective view of an alternative embodiment of the roller system of FIG. 1.
Figure 20:
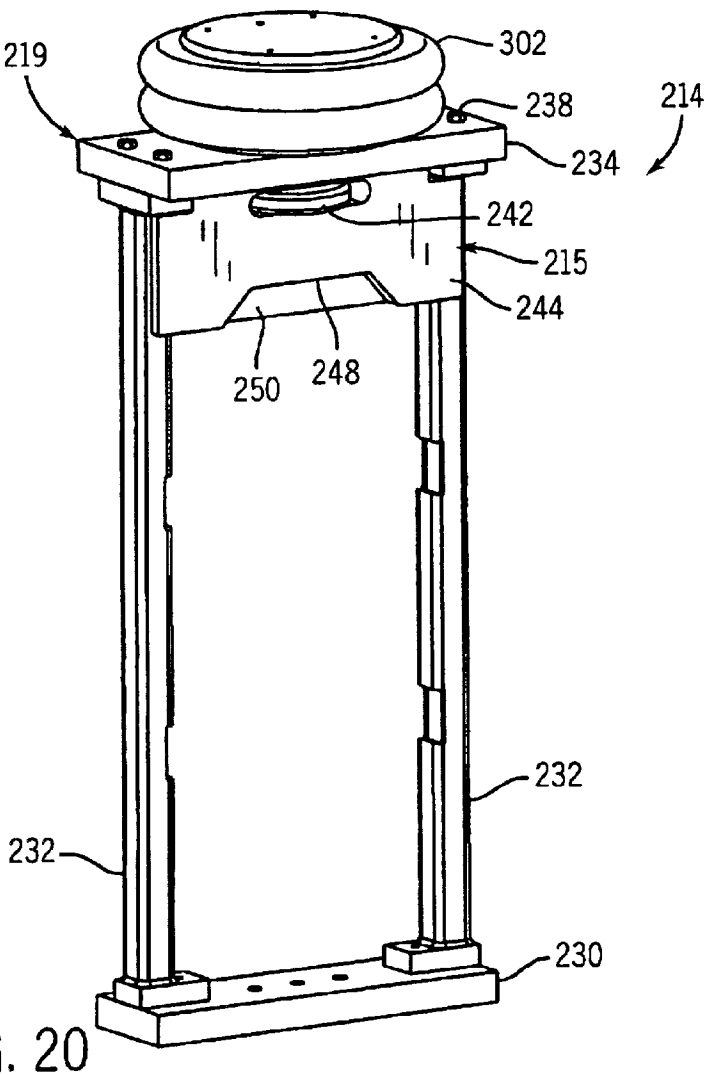
FIG. 20 is a perspective view of a frame half and actuation device of the roller system of FIG. 19.
Figure 21:
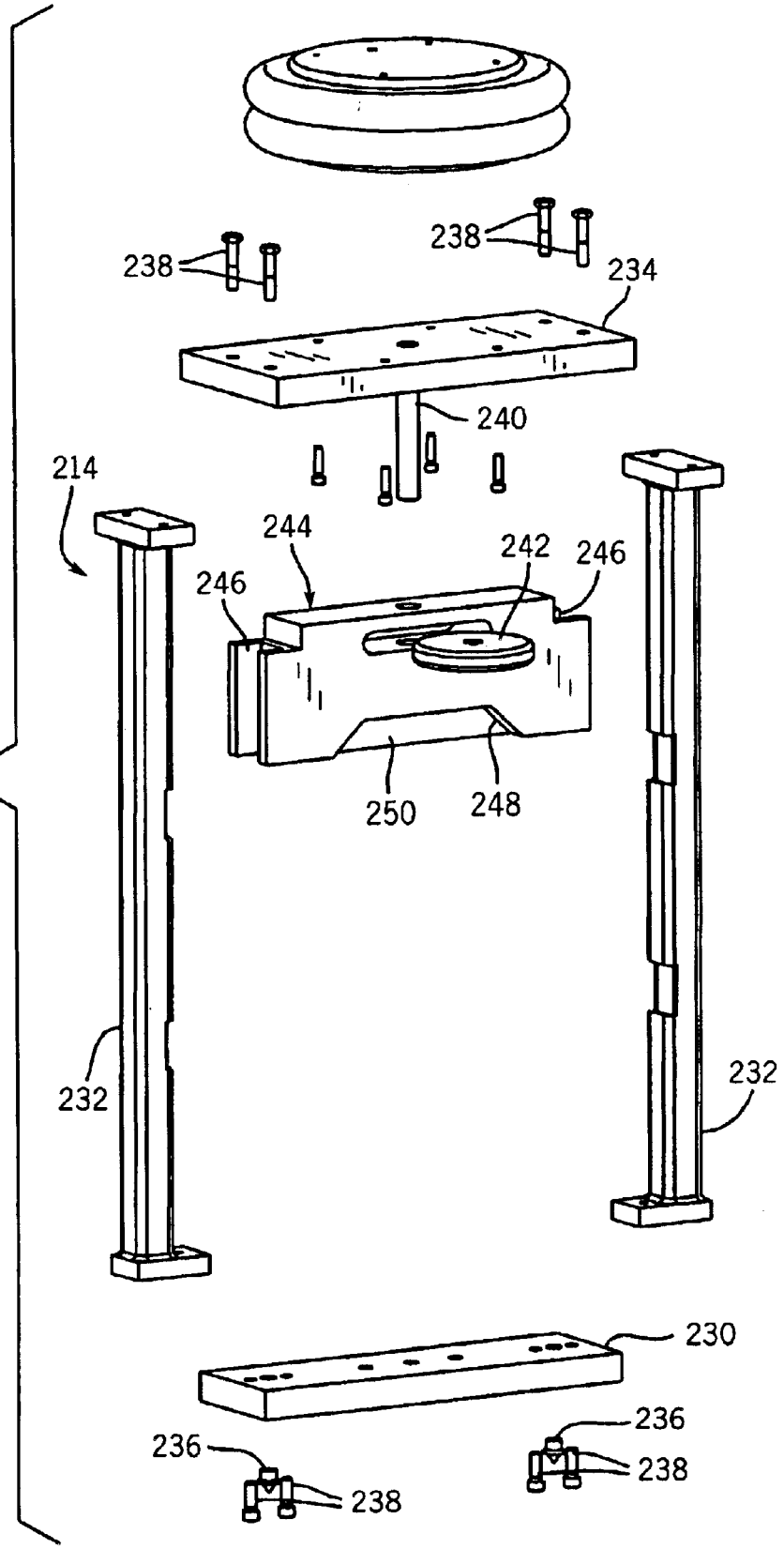
FIG. 21 is an exploded perspective view of the frame half and actuation device of FIG. 20.

FIGS. 19–30 illustrate wringer roller system 210, an alternative embodiment of wringer roller system 10. Wringer roller system 210 generally includes frame 214, upper roller assembly locator 215, upper roller assembly 216, lower roller assembly 218, actuators 220, and interfaces 221 provided by upper rails 222 and lower rails 224. Frame 214 generally comprises a base structure supporting the remaining components of system 210. Frame 214 generally includes two identical halves 219 situated on opposite ends of rails 222, 224. As best shown by FIGS. 20 and 21, frame 214 generally includes base plate 230, tie bars 232, top plate 234, and locating pins 236. Base plate 230 serves as a rigid structural member for being secured to the floor or other base. Tie bars 232 extend vertically upward from base plate 230 and are configured to support rails 222 and 224 at spaced locations. Top plate 234 extends across an upper end of tie bars 232 and supports upper roller assembly locator 215. Locating pins 236 extend from base plate 230 and serve to locate system 210 of the manufacturing floor. Although base plate 230, tie bars 232, and top plate 234 are illustrated as being secured to one another by fasteners 238 (shown in FIG. 21), such members may alternatively be integrally formed with one another, be mechanically interlocked to one another, be welded to one another, or otherwise be joined to one another by various other presently known or future developed coupling methods and arrangements. For purposes of this disclosure, the term "coupled" shall mean direct and indirect joining of two elements or components by fusing, bonding, welding, fastening, mechanically interlocking, integral formation and the like. Components are indirectly coupled to one another when an intermediate element is situated between the indirectly coupled elements.

Upper roller assembly locator 215 generally comprise a structure configured to facilitate the positioning of upper roller assembly 216 at a desired height based upon the intended pass line of the sheet of material passing between roller assemblies 216 and 218. In the particular embodiment illustrated, upper roller assembly locator 215 forms a structure configured to engage upper roller assembly 216 when upper roller assembly 216 attains a desired height. As shown by FIG. 19, upper roller assembly locator 215 is formed by two substantially identical locator assemblies 239 located at opposite ends of system 210. As best shown by FIGS. 20 and 21, each locator assembly of upper roller assembly locator 215 generally includes rod 240, wheel 242 and stop 244. Rod 240 extends from top plate 234 between tie bars 232 of frame 214. Rod 240 is externally threaded for threadably engaging wheel 242.

Wheel 242 threadably engages rod 240 and is coupled to stop 244. Rotation of wheel 242 vertically moves wheel 242 up and down along rod 240 to raise and lower stop 244. Stops 244 comprise a block coupled to wheel 242 and are movably supported by frame 214 for vertical movement between raised and lowered positions. In the particular embodiments illustrated, each stop 244 includes side channels 246 which receive at least portions of tie bars 232 such that stop 244 moves along tie bars 232. Stops 244 additionally include two opposing cut-outs 248 separated by an intermediate tongue 250. Cut-outs 248 and tongue 250 are configured to engage and preferably mate with upper roller assembly 216 when upper roller assembly 216 has been elevated to a desired height as established by the height of stop 244. Because cut-outs 248 and tongue 250 mate with portions of upper roller assembly 216, stop 244 further stabilizes upper roller assembly 216 against vibration and movement.

In operation, the vertical height of stops 244 may be easily adjusted by rotating wheel 242 along rod 240. Wheel 242 is preferably configured to enable such rotation to be done manually by hand without the need for additional tools or other equipment. Because wheel 242 is rotated along shaft 240, locators 215 provide continuous vertical adjustment of stop 244 along substantially the entire length of rod 240. As a result, stop 244 may be precisely adjusted as needed. To facilitate the positioning of stops 244 at both ends of system 210 at substantially the same height, at least one of tie bars 232 or alternative adjacent structures are preferably provided with height indicating indicia for alignment with selected marks, edges or other portions of stops 244. In yet alternative embodiments, system 10 may alternatively be provided with conventionally known or future developed level indicators coupled to either or both of upper roller assembly 216 or lower roller assembly 218 to facilitate the support of assemblies 216 and 218 in a level orientation. Alternatively, system 210 may be configured such that stops 244 are simultaneously raised and lowered. For example, wheels 242 at both ends of system 210 may be coupled to one another, such as by a belt or chain and the like, such that rotation of one wheel 242 simultaneously causes rotation of the other wheel 242 to simultaneously raise or lower stops 244.

Although less desirable, variously other presently known or future developed mechanisms or methods may be employed to vertically raise and lower stop 244 and to retain stop 244 at any one of a plurality of positions. For example, stop 244 may be raised and lowered between a plurality of preset, vertically spaced positions and releasably retained in such positions by a plurality of detents and detent engaging protuberances on opposing portions of tie bar 232 and stop 244.

In lieu of being manually raised and lowered, either continuously or discretely, stops 244 may be raised and lowered by pneumatic, electrical, hydraulic or other power means. For example, in alternative embodiments, stops 244 may be raised and lowered by means of a solenoid. In such alternative embodiments, stop 244 may be raised and lowered independently of one another or simultaneously with one another under the control of a control circuit or other device to ensure the proper positioning of both stops 244.

Furthermore, although less desirable, in lieu of physically engaging upper roller assembly 216 to limit the vertical extent to which upper roller assembly 216 may be raised, locator 215 may alternatively use other means for establishing a height for assemblies 216, 218 or positioning assemblies 216, 218 at the appropriate height and pass line. For example, a control circuit or other means may be configured to raise or lower either or both of roller assemblies 216, 218 based upon a sensed, detected or calculated height of assemblies 216, 218. In one alternative embodiment, sensors are provided which generate position signals based upon the vertical positioning of roller assemblies 216, 218. Based upon such location signals, a control circuit generates control signals, whereby an actuator raises or lowers roller assemblies 216, 218 based upon such control signals to precisely locate roller assemblies 216, 218.

In lieu of sensing the position of upper roller assembly 216 (or 218), various other mechanisms such as timing belts and the like may be employed to calculate the position of upper roller assembly 216 (or lower roller assembly 218) based upon the rate at which upper roller assembly 216 (or lower roller assembly 218) is elevated or lowered, and the lapsed time. In yet other alternative embodiments, system 210 may simply be provided with height identifying indicia, wherein upper roller assembly 216 (or possibly lower roller assembly 218) is iteratively raised and lowered until a certain indicia on the upper roller assembly 216 (or possibly lower roller assembly 218) is aligned with the stationary indicia, either coupled to the frame or another structure.

As shown by FIG. 19, rails 222 and 224 extend between frame halves 219 and serve as interfaces 221 coupled to frame 214 that are configured to interact with corresponding interfaces coupled to assemblies 216 and 218. Rails 222 and 224 are preferably configured to serve as both supports and tracks for upper roller assembly 216 and lower roller assembly 218. As supports, rails 222 and 224 retain assemblies 216 and 218 at distinct heights. As tracks, rails 222 and 224 align and guide movement of assemblies 216 and 218 along axes 256 and 258, respectively. Although rails 222 and 224 simultaneously serve both functions, other structures may alternatively be used to separately serve such functions. For example, platforms could be used to elevate assemblies 216 and 218 while other structures such as side tracks, bars or other mechanisms may be used to guide movement of assemblies 216, 218 along axes 256, 258, respectively.

In the particular embodiment illustrated in FIG. 19, rails 222 and 224 comprise opposing bars of angle iron. Alternatively, rails 222, 224 may comprise other structures configured to support and track assemblies 216, 218. Although in the particular embodiment illustrated, assemblies 216 and 218 are illustrated as resting upon rails 222 and 224, assemblies 216 and 218 may alternatively be supported by a single underlying track or by one or more overhead tracks from which assemblies 216 and 218 would be suspended. In another alternative embodiment, lower assemblies 216 and 218 would be both supported and guided by means of rods or shafts coaxially extending through assemblies 216 and 218, wherein assemblies 216, 218 roll, slide or otherwise move along the rods.

Figure 24:
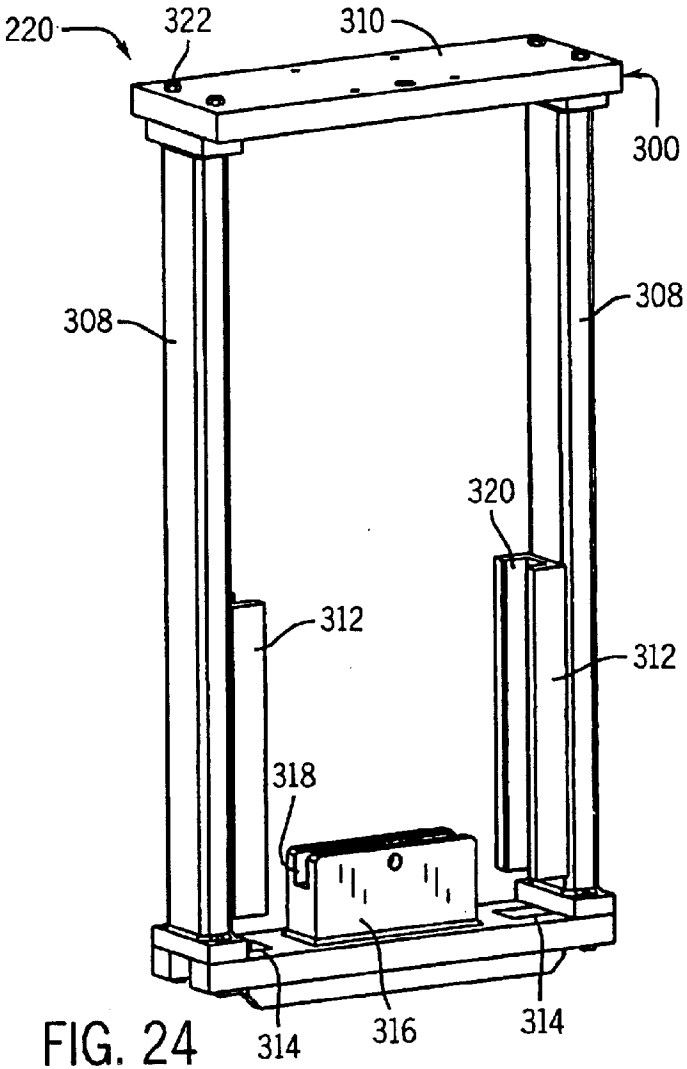
FIG. 24 is a perspective view of a movable frame of the roller system of FIG. 19.

FIGS. 19 and 24 illustrate upper roller assembly 216 and lower roller assembly 218 in greater detail. Although, in the particular embodiment illustrated, upper roller assembly 216 and lower roller assembly 218 are identical to one another and are interchangeable with one another, assemblies 216 and 218 may have different configurations while still being interchangeable or not interchangeable. Roller assemblies 216 and 218 are configured to cooperatively work upon a sheet or strip of material passing between them. In the particular embodiment illustrated, assemblies 216 and 218 are specifically configured to displace fluid off of a web or strip passing therebetween. In alternative applications, roller assemblies 216, 218 have other configurations as necessary depending upon how the sheet or strip passing between assemblies 216 and 218 are being worked or treated.

Roller assemblies 216 and 218 each generally include cylindrical member 260, bearing block 262 and interfaces 264. Cylindrical member 260 comprises an elongate and a cylindrical structure extending along either axis 256 or 258. In the particular embodiment illustrated, cylindrical member 260 has a generally smooth outer circumferential surface configured to squeegee fluids from a sheet passing between members 260 of assemblies 216 and 218. In the particular embodiment illustrated, the outer surface of cylindrical member 260 may include materials such as rubber or other conventionally known or future developed elastomeric or compressible materials. In alternative applications, the surface of cylindrical member 260 may include raised and depressed portions, such as for example, when corresponding printing or embossing is being performed on the sheet of material passing between adjacent members 260. In alternative applications, the outer circumferential surface of member 260 may be composed of other non-elastomeric materials, such as metal and the like where, for example, rollers 260 are to heat or cool the strip of material passing between adjacent members 260.

Figure 23:
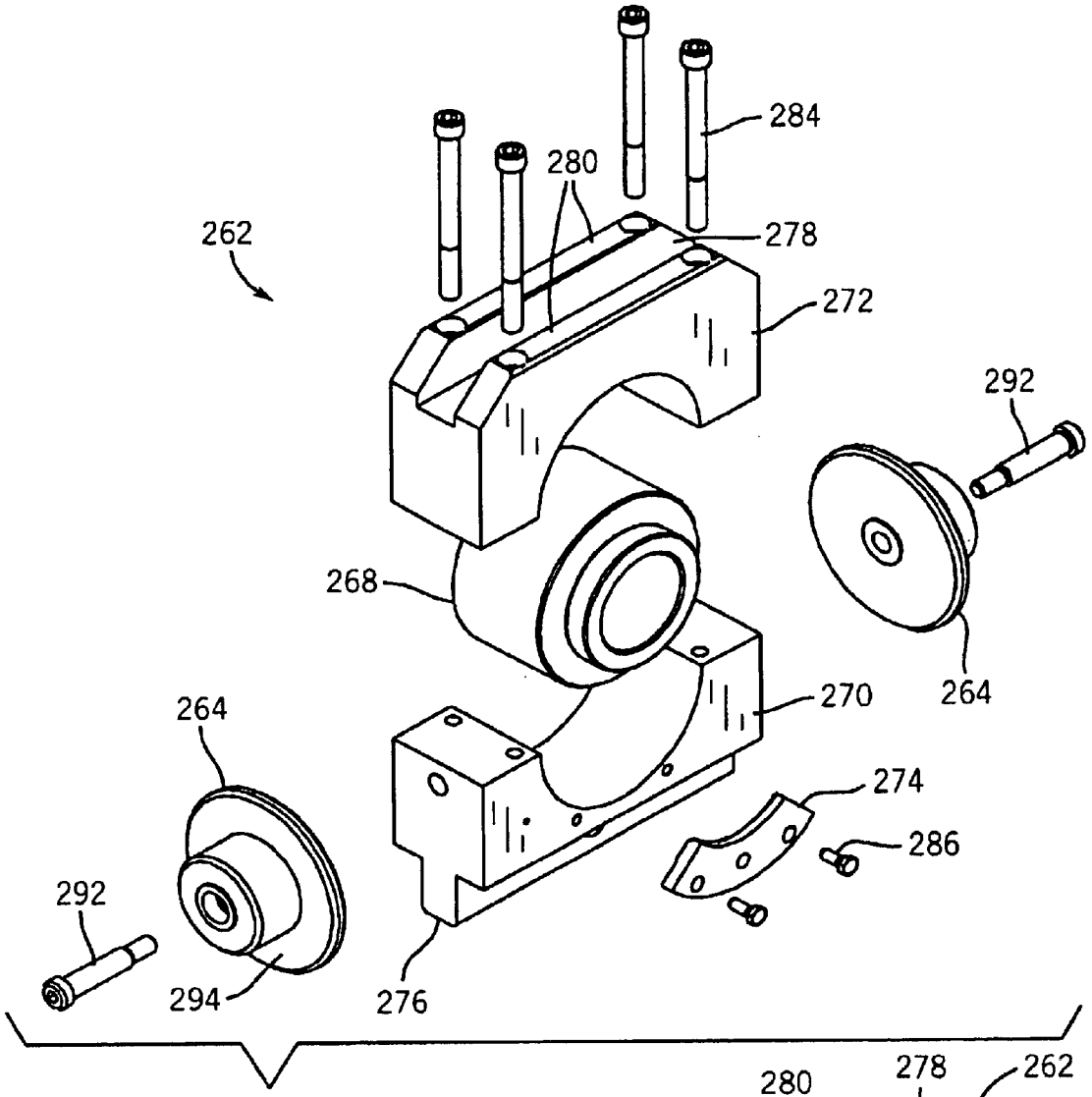
FIG. 23 is an exploded perspective view of the bearing block and interface of FIG. 22.
Figure 22:
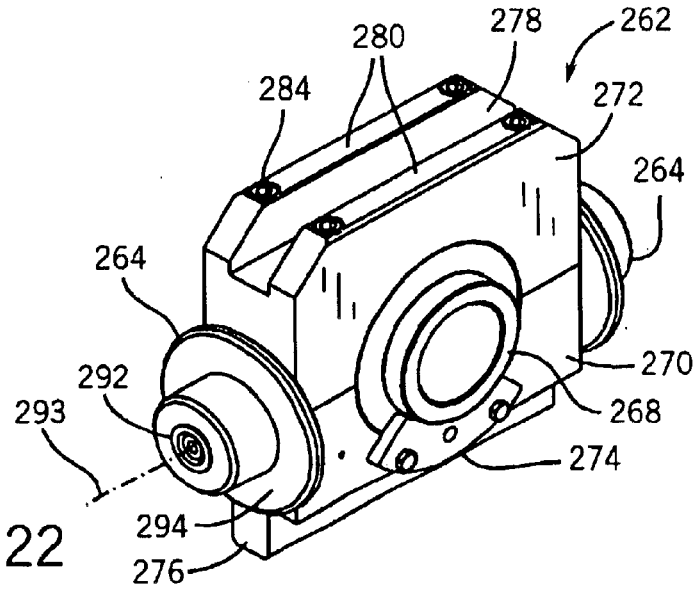
FIG. 22 is a perspective view of a bearing block and interface of the roller assembly of FIG. 19.

Bearing blocks are coupled to opposite ends of members 260 and are configured to rotatably support members 260 about axes 256 and 258. Although bearing blocks 262 on opposite ends of member 260 are substantially identical to one another, differently configured bearing blocks may be alternatively provided on opposite ends of each member 260. FIGS. 22 and 23 illustrate one particular embodiment of bearing block 262. Bearing block 262 generally includes bearing 268, lower block portion 270, upper block cap 272 and keeper 274. Bearing 268 comprises a conventionally known structure configured for rotatably supporting an axial end of member 260. Although bearing 268 preferably comprises a radial, bearing 268 may alternatively comprise other conventionally known or future developed bearing structures.

Lower block member 270 and upper cap 272 surround and capture bearing 268 therebetween. Lower portion 270 and cap 272 further facilitate interengagement between assemblies 216 and 218, interengagement between lower assembly 218 and actuator 220 and interengagement between upper roller assembly 216 and locator 215. To this end, lower block portion 270 includes tongue 276 while upper cap 272 includes groove 278. Tongue 276 extends at a lower end of portion 270 and is configured to be received within groove 278 of cap 272 and a groove provided as part of actuator 220 as described hereafter. Groove 278 extends at an upper end of cap 272 and is configured to receive tongue 276 of lower portion 270 or tongue 250 of stop 244. In the particular embodiment illustrated, the opposing walls 280 of cap 272 which form groove 278 are configured to be received within cut-out 248 of stop 244. Preferably, walls 280 are configured so as to mate within cut-out 248. In addition, groove 278 is dimensioned so as to closely receive 250. As a result, cap 272 is configured to closely interlock with stop 244 to reduce vibration and undesirable movement. Likewise, tongue 276 is also configured to closely fit within groove 278 of cap 272 when interengaged or to closely fit within the groove provided by the actuator 220 to stabilize assemblies 216 and 218. Although walls 280 and cut-outs 248 are illustrated as being semi-hexagonal in shape, such mating relationships may be provided by various other configurations and shapes.

Bearing keeper 274 generally comprises a structure coupled to lower portion 270 and configured to assist in retaining bearing 268 in place. As will be appreciated, various other conventionally known or future developed structures may be used to retain bearing 268 in place. Furthermore, although lower portion 270, cap 272 and keeper 274 are illustrated as being secured to one another by fasteners 284 and 286, various other fastener mechanisms may also be used. In still alternative embodiments, portion 270 and caps 272 may be mechanically interlocked or may be integrally formed as a single unitary body. Depending upon the type and configuration of bearing 268 employed, keeper 274 may have other configurations, may be integrally formed, permanently secured to either portion 270 or cap 272, or may be omitted entirely. In still alternative embodiments, bearing 268 may be fastened to or integrally formed as part of the remainder of bearing block 262. The present design, however, facilitates ease of manufacturing, assembly and repair.

FIGS. 22 and 23 also illustrate interfaces 264 in greater detail. Interfaces 264 cooperate with rails 224 to movably support assemblies 216 and 218 for movement along axes 256 and 258. Interfaces 264 preferably comprise wheels 290. Wheels 290 are coupled to bearing block 262 by fasteners 292 and rotate about axis 293 which extends generally perpendicular to axes 256 and 258. In the particular embodiment illustrated, each wheel 290 mates with rail 224 so as to guide movement of assemblies 216 and 218 along rail 224 in addition to movably supporting assemblies 216 and 218 along rails 224. This mating is preferably provided by shoulders 294 which bear against the surfaces of rail 224.

Although assemblies 216 and 218 are illustrated as including wheels 290 which function as interfaces that interact with interfaces 221 provided by rails 222 and 224, assemblies 216 and 218 may alternatively be provided with other interfaces which interact with rails 222, 224 or other forms of interfaces coupled to frame 214. Although interfaces 264 are illustrated as including two substantially identical opposite wheels, interfaces 264 may alternatively include opposite but differently configured wheels. In lieu of comprising wheels, the interface may comprise a rail, track or other structure which rides upon wheels supported by rails 224 or supported by frame 214. In one alternative embodiment, rails 222, 224 may be omitted, wherein the interfaces coupled to assemblies 216, 218 comprise elongate rails coupled to and extending between opposite bearing blocks 262 and wherein wheels or other low friction interfaces are coupled to opposite halves of frame 214. In lieu of comprising wheels, the interfaces may comprise any conventionally known or future developed mechanism that is movable along rails 224 and that provides a low friction interface. Examples include members coated or formed from a low friction material such as polytetrafluoroethylene, structures that carry bearing balls, structures that are provided with air bearings (air jets which form a cushion of air) or other similar mechanisms.

Figure 25:
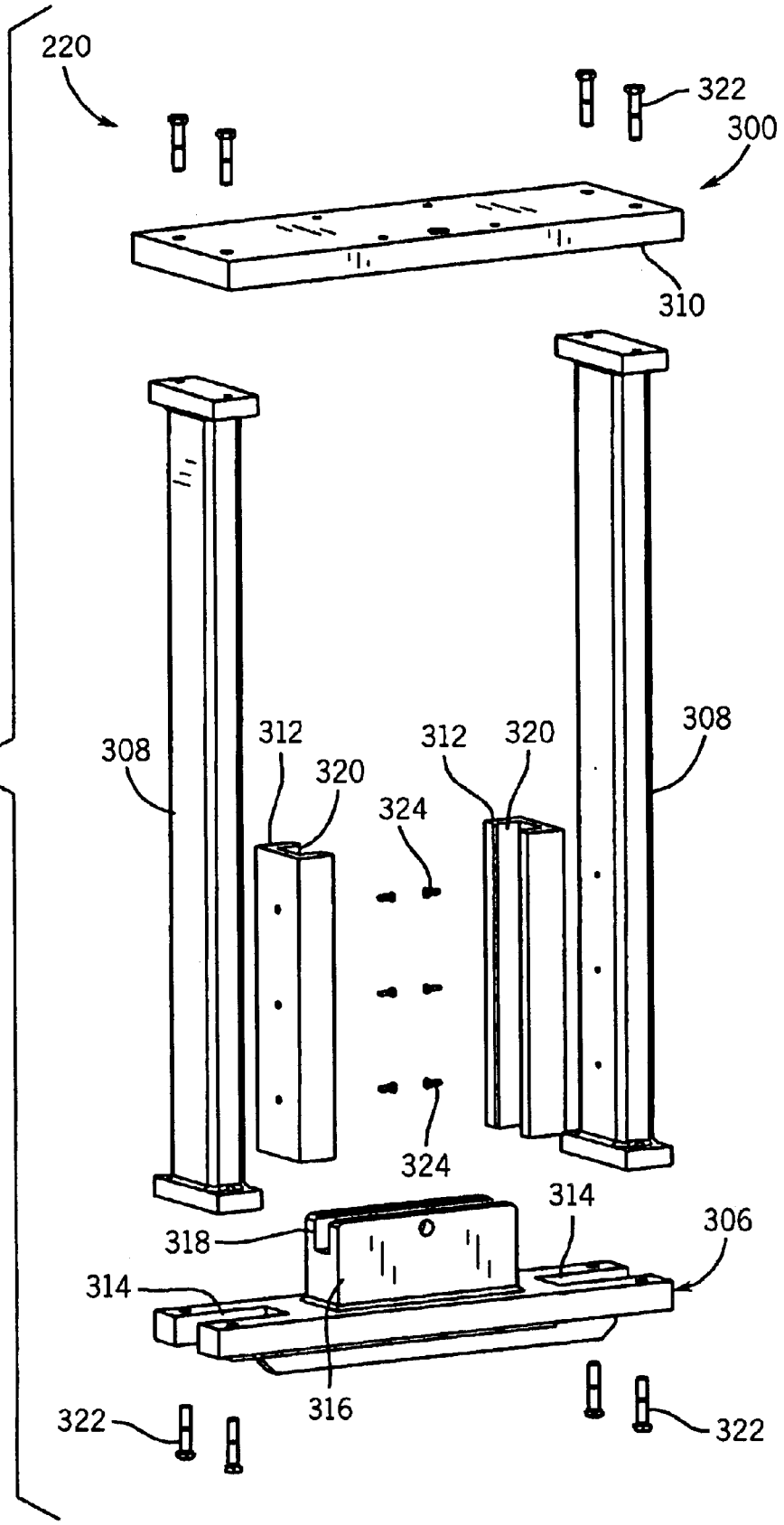
FIG. 25 is an exploded perspective view of the movable frame of FIG. 24.

Actuator 220 raises and lowers lower roller assembly 218 between a raised position and a lowered position. In the particular embodiment illustrated, actuator 220 also raises and lowers upper roller assembly 216 between a raised position and a lowered position. System 210 includes a pair of actuators located opposite axial ends of assemblies 216, 218. In the particular embodiment illustrated, actuators 220 are configured to move lower roller assembly 218 between an elevated position in which cylindrical member 260 of assembly 218 is spaced from cylindrical member 260 of upper assembly 216 so as to cooperate with cylindrical member 260 of upper assembly 216 to remove or squeegee fluids or other materials from a strip passing between members 260. In the lower position, lower roller assembly 218 rests upon rails 224 at a location spaced below member 260 of upper roller assembly 216 and below the strip. FIGS. 19, 24 and 25 illustrate actuator 220. Each actuator 220 generally includes a movable frame 300 and lift/lower device 302 (best shown in FIGS. 19 and 20). Movable frame 300 generally comprises a structure coupling lift/lower device 302 and lower roller assembly 218. Movable frame 300 generally includes base 306, tie bars 308, top plate 310, and guides 312. Base 306 extends at a lower end of frame 300 and includes openings 314 and grip 316. Apertures 314 are located on opposite sides of base 306 and are configured to slidably receive tie bars 232 of one of frame halves 219 such that base 306 may be fit between tie bars 232 between bottom plate 230 and stop 244. Apertures 314 engage tie bars 232 to guide movement of frame 300 vertically along tie bars 232. In alternative embodiments, base 306 may be provided with tongues or other projections which slidably engage corresponding grooves or similar structures provided on tie bars 232 to guide movement of frame 300.

Grip 316 comprises a projection extending upwardly from base 306. Grip 316 is configured to engage tongue 276 (shown in FIG. 23) of a bearing block 262. Grips 316 includes a channel or groove 318 configured to receive tongue 276. In alternative embodiments, grip 316 may include a tongue which is configured to project into a groove provided on bearing block 262. In other alternative embodiments, various other conventionally known or future developed inner engaging or mating structures may be employed.

Tie bars 308 extend upwardly from base 306 and are spaced apart so as to extend to the outside of tie bars 232 of frame halves 219. Top plate 310 extends across tie bars 308 opposite base 306 and supports lift/lower device 302. Overall, base 306, tie bars 308 and top plate 310 provide a rigid rectangular structure vertically movable relative to frame half 219. Although less desirable, tie bars 308 may be replaced with other inner connecting structures, such as cables, and top plate 310 may be omitted depending upon the configuration of lift/lower device 302.

Guides 312 are coupled to tie bars 308 and further facilitate vertical movement of frame 300 along tie bars 232 of frame half 219. Guide 312 preferably comprises an elongate U-shaped members which provide channels 320 that receive tie bars 232. Guides 312 are preferably formed from low friction material such as high density polyethylene. In alternative embodiments, various other structures may be employed to guide movement of frame 300 along frame half 219 in a vertical direction and to reduce friction. Although the components of frame 300 are illustrated as being secured to one another by fasteners 322 and 324, various other fasteners may also be employed to join such members. Furthermore, such members may alternatively be bonded, welded, mechanically interlocked, or integrally formed as part of a single unitary body with one another.

Lift/lower device 302 is positioned between top plate 234 of frame half 219 and top plate 310 of frame 300. In the particular embodiment illustrated, device 302 is fastened to each of plates 234 and 310. Alternatively, device 302 may be fastened to one or neither of such plates. Lift/lower device 302 generally comprises a linear actuating mechanism configured to raise and lower frame 300 relative to frame half 219 of frame 214. Because device 302 is situated overhead, above assemblies 216 and 218, system 210 has a lower profile and narrower footprint, enabling system 210 to be placed in tighter envelopes.

In the particular embodiment illustrated, device 302 comprises a bellows, such as a Firestone 232-air stroke actuator provided by Firestone Industrial Products Company. Various other bellows may also be employed. As a result, device 302 is selectively inflatable to raise and lower frame 202 which thereby raises and lowers lower roller assembly 218 and upper roller assembly 216 as described in greater detail hereafter with respect to FIGS. 26–31. Because device 302 further comprises a bellows, device 302 is capable of generating large forces upon being inflated. At the same time, device 302 is capable of absorbing shock or other forces. Furthermore, because the bellows forming device providing device 302 is generally formed from elastomeric material or polymeric material, device 302 is extremely corrosion resistant. Although less desirable, device 302 may comprise other conventionally known or future developed linear actuating mechanisms such as hydraulic or pneumatic cylinder-piston assemblies, electric solenoid actuation mechanisms or various other mechanical actuation mechanisms configured to selectively raise and lower lower roller assembly 218 and possibly upper roller assembly 216.

Figure 26:
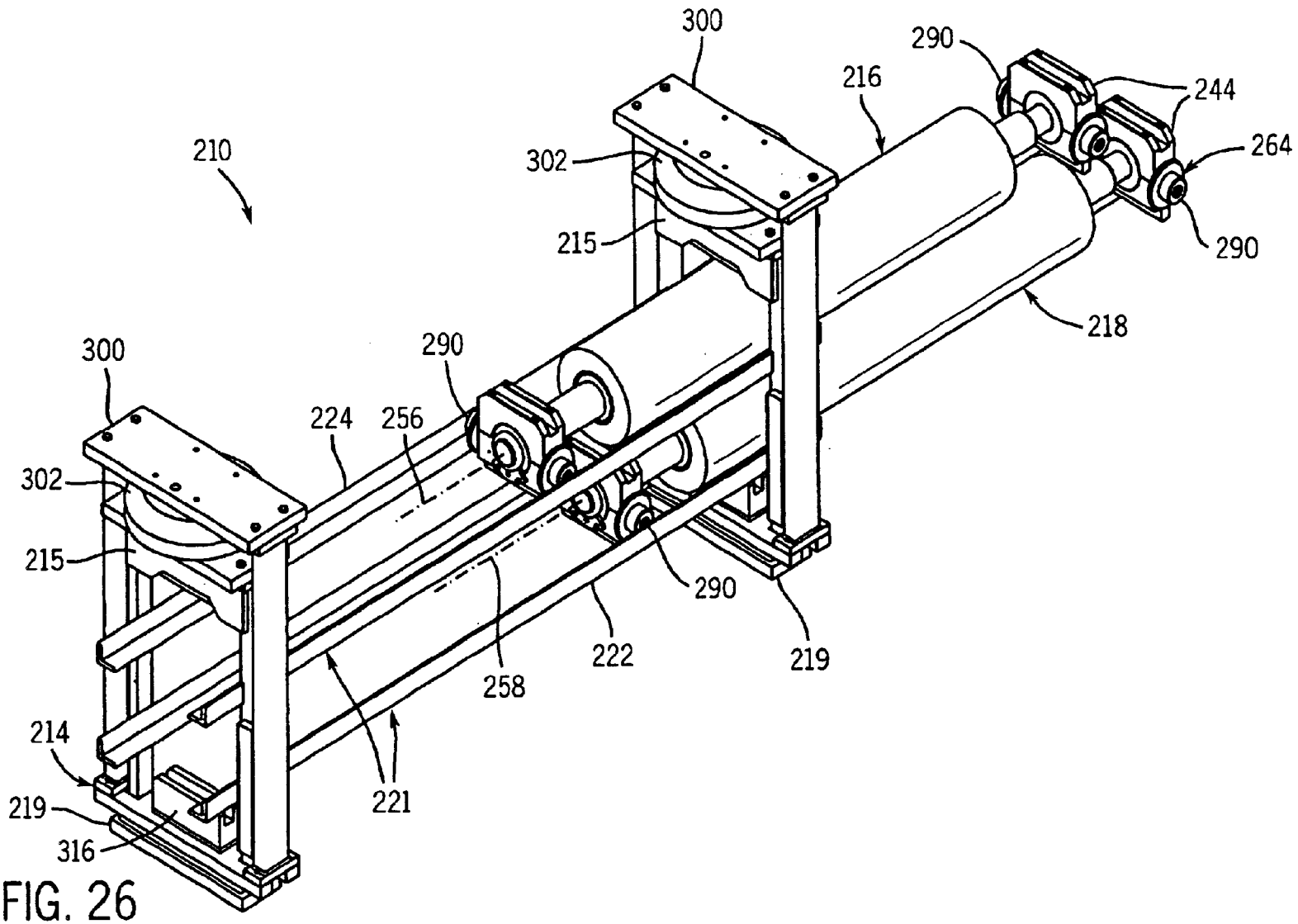
FIG. 26 is a perspective view of the roller system of FIG. 19 illustrating an upper roller assembly and a lower roller assembly partially removed from the frame of the system.
Figure 27:
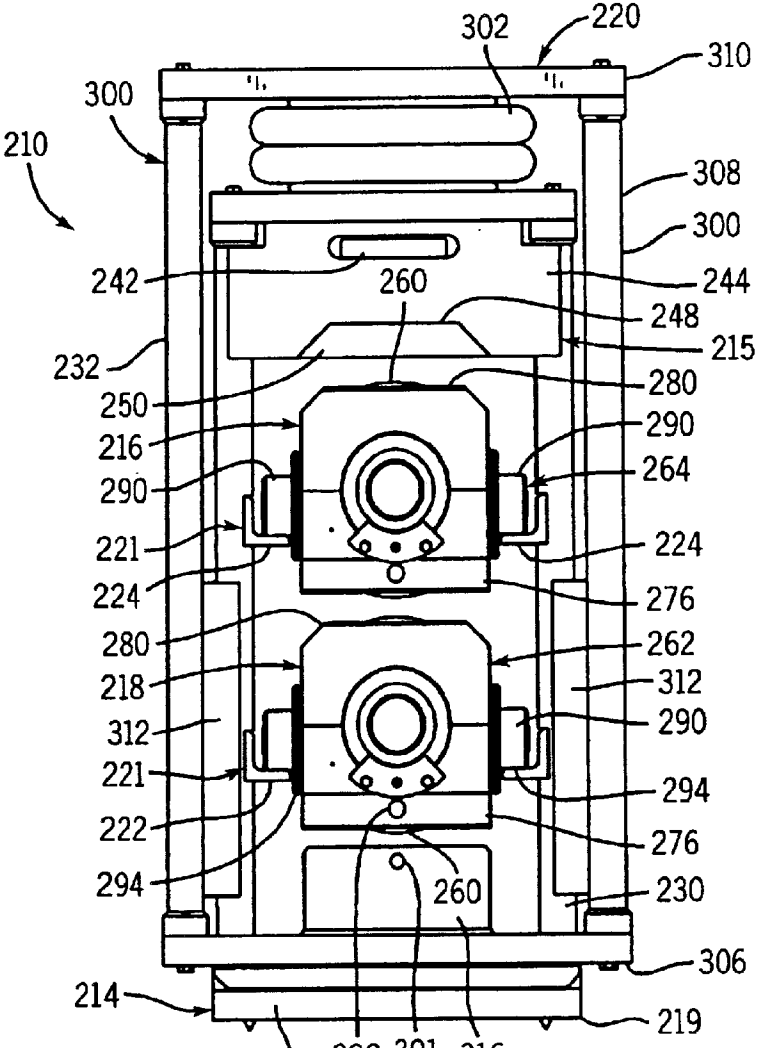
FIG. 27 is an end elevational view of the roller system of FIG. 26.

FIGS. 26–31 illustrate the operation of system 210. As shown by FIGS. 26 and 27, roller assemblies 216 and 218 are initially located outside of frame 214, and are inserted at least partially between frame ends or halves 219 through the axial end of one of frame halves 219. In particular, roller assemblies 216 and 218 are moved along axes 256 and 258, respectively, between tie bars 232 of frame ends 219 and between tie bars 308 of movable frame 300. Movement of assemblies 216 and 218 along axes 256 and 258, respectively, is facilitated by rails 222 and 224, respectively. In the particular embodiment illustrated, wheels 290 rotatably engage rails 222 and 224 to allow assemblies 216 and 218 to be rolled into position. In alternative embodiments where alternative interfaces are employed, such positioning of assemblies 216 and 218 may occur by other means. As assemblies 216 and 218 are moved into position between frame halves 219, stops 244 are preferably is in a raised position to avoid interference with upper roller assembly 216. Actuators 220 are in lowered positions such that grips 316 do not interfere with the movement of lower roller assembly 218.

Although FIGS. 26 and 27 illustrate the insertion of both upper roller assembly 216 and lower roller assembly 218 through the axial end of the far frame half 219, assemblies 216 and 218 may alternatively be inserted through the axial end of the near frame half 219. In lieu of being inserted through the axial end of the same frame half 219, assemblies 216 and 218 may be inserted through the axial end of opposite frame halves 219. As will be appreciated in some instances, it may not be necessary to insert only one of assemblies 216 and 218. Although less desirable, system 210 may alternatively be configured such that assemblies 216, 218 may be inserted in only one of frame halves 219 or such that assemblies 216 and 218 must be inserted through opposite axial ends of frame 214.

Figure 29:
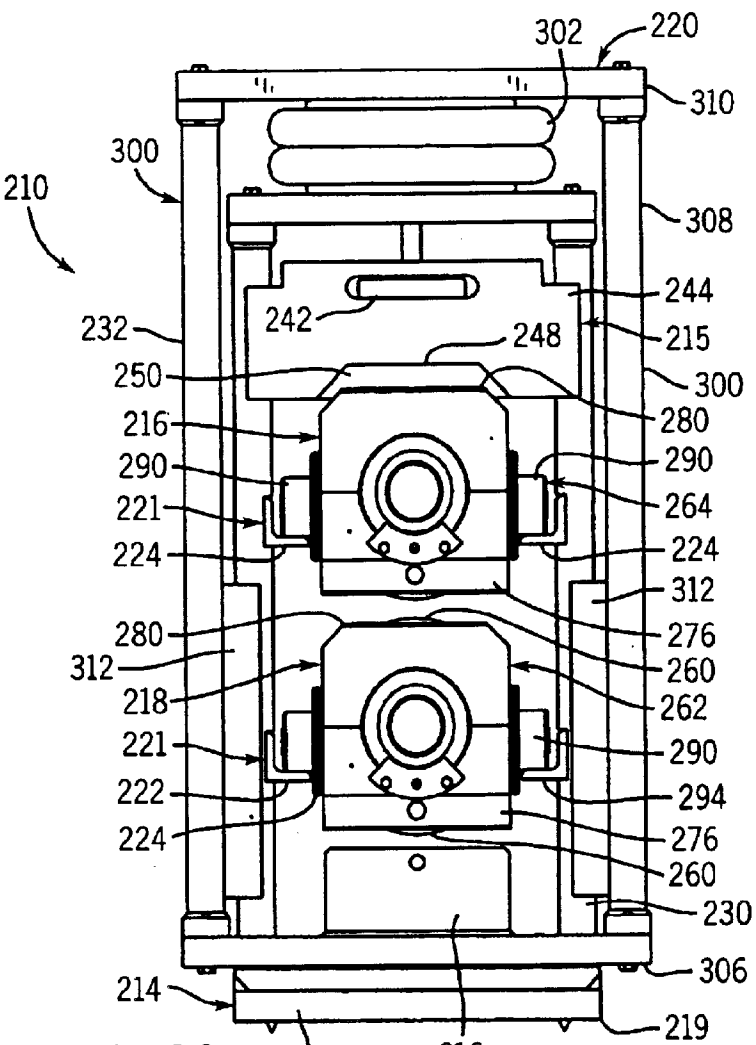
FIG. 29 is an end elevational view of the roller system in FIG. 28.

FIGS. 26 and 27 illustrate system 210 and stop 244 in a lowered position and with assemblies 216, 218 also in a lowered position. FIGS. 28 and 29 illustrate locator 215 adjusted to establish a height at which assemblies 216 and 218 are to be raised such that members 260 are correctly positioned with respect to the pass line of the sheet passing between members 260. In the particular embodiment illustrated, hand wheel 242 is rotated so as to lower stop 244 until lower portion of stop 244, which includes cut-out 248 and tongue 250, are at the appropriate height. This step is completed at both axial ends of system 210.

Figure 31:
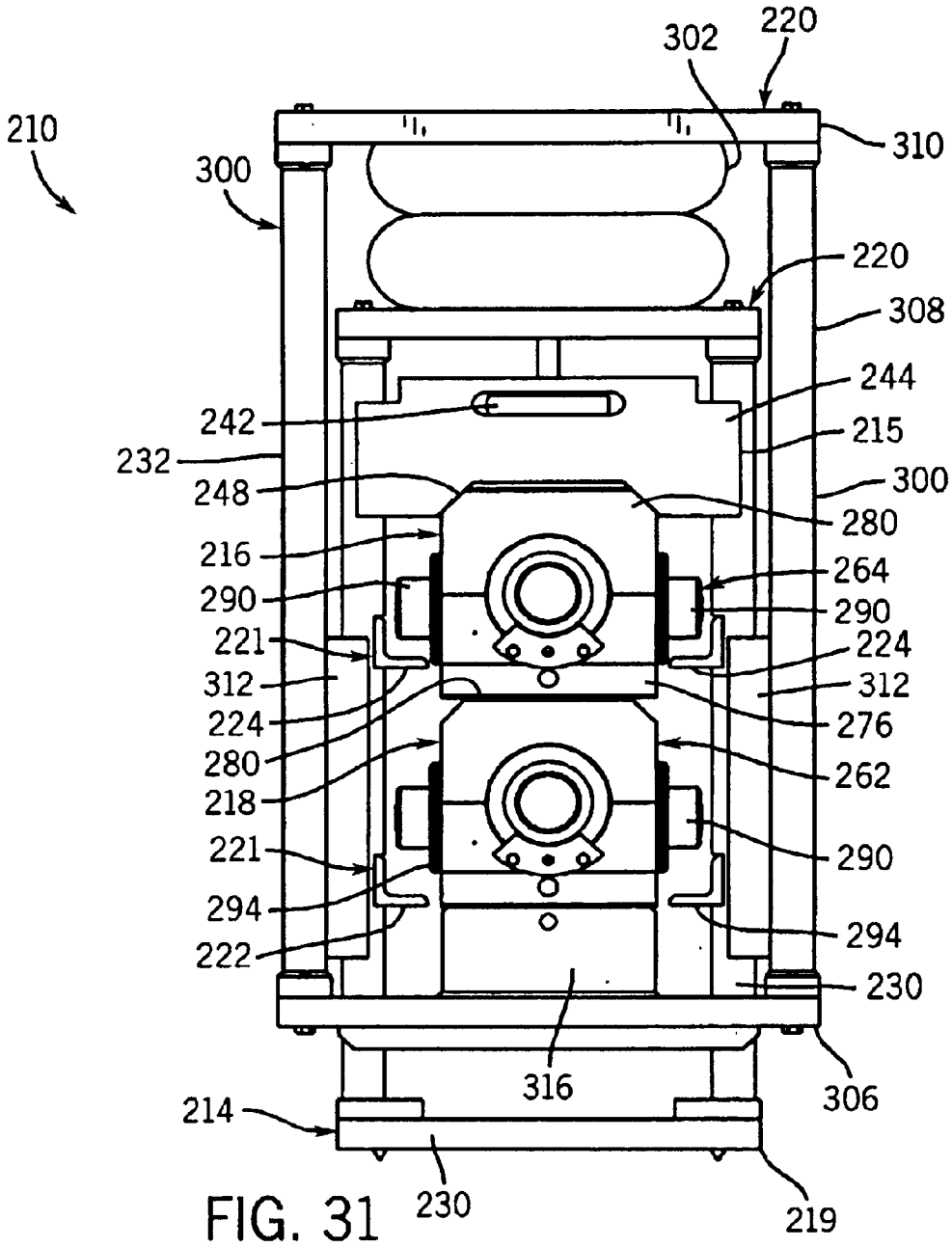
FIG. 31 is an end elevational view of the roller system of FIG. 30.

FIGS. 30 and 31 illustrate system 210 with assemblies 216, 218 in raised positions. As shown by FIGS. 30 and 31, actuator 220 is lifted or raised to lower roller assembly 218 into engagement with upper roller assembly 216. Actuator 220 is further lifted or raised to lower roller assembly 218 such that assembly 218 lifts upper roller assembly 216 into engagement with stop 244 at the established pass line. In the particular embodiment illustrated, device 302 is inflated so as to lift movable frame 300 relative to frame half 219. As a result, grip 316 is raised into engagement with tongue 276 of lower roller assembly 218. When engaged, groove 318 receives tongue 276 to interlock such members. Lower roller assembly 218 and grip 316 may be further interlocked with one another by inserting a pin (not shown) through the parallel lined openings 390 and 391 of lower roller assembly 218 and grip 316, respectively. Device 302 is further inflated so as to raise movable frame 300 and lower roller assembly 218 until walls 280 of the bearing blocks 262 of lower roller assembly 218 receive tongue 276 of upper roller assembly 216 within channel 278. Both lower roller assembly 218 and upper roller assembly 216 are further elevated until walls 280 of bearing block 262 of upper roller assembly 216 receive tongue 250 of stop 244 within channel 278. At the same time, walls 280 of upper roller assembly 216 mate within cut-out 248 for stable and precise positioning of assemblies 216 and 218.

To remove one or both of assemblies 216, 218 for repair, cleaning or replacement, the above-described steps are completed in reverse order. In particular, device 302 is deflated to lower movable frame 300 relative to its respective frame half 219. This deflation of device 302 continues until assemblies 216, 218 rest upon rails 222 and 224, and until tongue 276 of lower roller assembly 218 is removed from grip 316. Thereafter, roller assemblies 216, 218 may be moved along axes 256 and 258 through an end opening of frame 214 as facilitated by interfaces 221 and 264. Depending upon the position of stop 244, stop 244 may need to be raised either before or after assemblies 216 and 218 are lowered onto rails 222 and 224.

Overall, system 210 provides a relatively simple and compact arrangement that enables assemblies 216 and 218 to be easily removed for cleaning, repair, or replacement. Assemblies 216 and 218 may be simply moved along axes 256 and 258 through one of the open ended frame halves 219 during removal or reloading of assemblies 216, 218. Because actuator device 302 is situated overhead, system 210 has a narrower footprint and may be placed in tighter envelopes. Moreover, because device 302 lifts the lower roller into the upper roller, failure of lift/lower device 302 does not result in the development of flat spots upon the roll assemblies 216, 218. For example, if actuation device 302 comprises the preferred bellows, the loss of air pressure, either due to a power failure or to a prolonged down time, results in the lower roller assembly drifting downward away from the upper roll rather than resulting in the upper roller assembly drifting downward so as to come to rest upon the lower roller assembly which may cause flat spots on the rolls at their point of contact to one another.

Although the above-described structure is illustrated as being employed as part of a wringer roller system, the above-described system and its independent features may have additional applications in other roller systems wherein non-rotatably driven or rotatably driven cylindrical members are utilized to work upon a work piece or strip of material and wherein such roller members must be periodically cleaned, repaired or replaced. For example, the above-described independent features and mechanisms may be employed in printing applications where material, like ink, is deposited by rollers or in applications where rollers or drums are used to chill or heat/dry strips of materials such as paper, plastics and the like. In addition, such features may be employed in processes where materials are extruded and worked upon by one or more cylindrical surfaces of rollers. Such alternative applications are contemplated within the scope of the present disclosure.

Although the present invention has been described with reference to preferred embodiments, workers skilled in the art will recognize that changes may be made in form and detail without departing from the spirit and scope of the invention. For example, although different preferred embodiments may have been described as including one or more features providing one or more benefits, it is contemplated that the described features may be interchanged with one another or alternatively be combined with one another in the described preferred embodiments or in other alternative embodiments. The system 10 includes several features in combination with one another which may be employed independently of one another depending on the particular application. Because the technology of the present invention is relatively complex, not all changes in the technology are foreseeable. The present invention described with reference to the preferred embodiments and set forth in the above definitions is manifestly intended to be as broad as possible. For example, unless specifically otherwise noted, the definitions reciting a single particular element also encompass a plurality of such particular elements.

What is claimed is:

1. A roller system comprising:

a frame;

an upper roller assembly supported by the frame and including a first rotatably supported cylindrical member, wherein the upper roller assembly is movably supported by the frame between a raised position and a lowered position;

a lower roller assembly movably supported by the frame below the upper roller assembly and including a second rotatably supported cylindrical member, wherein the first member and the second member configured to engage opposite sides of a workpiece passing between the first member and the second member;

an actuator configured to move the second cylindrical member relative to the first cylindrical member and between an elevated position in which axial ends and an axial midpoint of the second member are raised and a lowered position in which the axial ends and the axial midpoint are lowered;

at least one first support configured to movably support the lower roller assembly for movement between operation position and an at least partially removed position relative to the frame when the lower roller assembly is in the lowered position;

at least one second support vertically spaced above the at least one first support and configured to movably support the upper roller assembly between an operation position and an at least partially removed position relative to the frame when the upper roller assembly is in the lowered position.

2. The system of claim 1 wherein the at least one first support includes at least one track configured to permit movement of the lower roller assembly along the at least one track, wherein the lower roller assembly moves along the track between an operation position and a removed position.

3. The system of claim 2 above wherein the lower roller assembly is detached from the track, the frame and the actuator in the removed position.

4. The system of claim 2 above wherein the lower roller assembly includes at least one low resistance interface configured to move along the track.

5. The system of claim 4 above wherein the lower resistance interface includes roller wheels.

6. The system of claim 1 above wherein one of the lower roller assembly and the at least one first support includes track and the other of the lower roller assembly and the at least one first support includes a low resistance interface.

7. The system of claim 6 above wherein the track and the low resistance interface guide movement of the lower roller assembly in a direction along a rotational axis of the second cylindrical member.

8. The system of claim 1 above wherein the actuator lifts the lower roller assembly off of the support when the actuator moves the second cylindrical member from the lowered position to the elevated position.

9. The system of claim 1 above wherein the actuator includes an air-driven actuator.

10. The system of claim 9 above wherein the actuator includes a bellows.

11. The system of claim 1 above wherein the lower roller assembly is configured to releasably mate with at least one of the frame and the upper roller assembly when the second cylindrical member is in the elevated position to inhibit non-rotational movement of the lower roller assembly relative to the frame or the upper roller assembly.

12. The system of claim 11 above wherein movement of the lower roller assembly in a direction along rotational axis of the second cylindrical member is prevented.

13. The system of claim 11 above wherein the lower roller assembly and the upper roller assembly releasably mate with one another.

14. The system of claim 1 above wherein the frame includes at least one guide configured to guide movement of the lower roller assembly.

15. The system of claim 1 above wherein the frame includes at least one guide configured to guide movement of the actuator.

16. The system of claim 1 wherein the actuator is located below the lower roller assembly.

17. The system of claim 1 wherein the actuator is located above the lower roller assembly.

18. The system of claim 1 wherein the at least one second support includes at least one track configured for movement of the upper roller assembly along the at least one track, wherein the upper roller assembly moves along the track between an operation position and a removed position.

19. The system of claim 1 wherein the upper roller assembly and the lower roller assembly are substantially identical to one another so as to be interchangeable with one another.

20. The system of claim 1 wherein the upper roller assembly is vertically movable between a raised position and a lower position and wherein the actuator is configured to move the upper roller assembly between the raised position and the lower position.

21. The system of claim 1 including a stop vertically movable between a plurality of positions, wherein the upper roller assembly is vertically movable between a raised position in which the upper roller assembly engages the stop and a lower position.

22. The system of claim 21 including means for retaining the stop at each of the plurality of the positions.

23. The system of claim 21 including a continuous height adjustment mechanism configured to continuously vertically adjust a height of the stop.

24. The system of claim 23 wherein the continuous height adjustment mechanism includes:

a threaded rod supported by the frame; and a wheel threadably engaging the threaded rod and coupled to the stop, whereby rotation of the wheel continuously vertically adjusts a height of the stop along the threaded rod.

25. The system of claim 1 including means for establishing a height of at least one of the upper roller assembly and the lower roller assembly.

26. The system of claim 1 wherein the system comprises a wringer roller system and wherein the first cylindrical member and the second cylindrical member include exterior cylindrical surface configured to cooperate with one another to displace fluid off of a web or strip passing therebetween.

27. The system of claim 26 wherein the cylindrical surfaces include portions configured to engage the strip passing between the first cylindrical member and the second cylindrical member and wherein substantially the entirety of the portions are smooth and are compressible or elastomeric.

28. A roller system comprising:

a frame;

an upper roller assembly including a first rotatably supported cylindrical member extending along an upper axis, wherein the upper roller assembly moves along the upper axis between an operation position and a removed position;

a lower roller assembly including a second rotatably supported cylindrical member extending along a lower axis, wherein the first member and the second member are configured to engage opposite side of a workpiece passing between the first member and the second member and wherein the lower roller assembly moves along the lower axis between an operation position and a remove position;

at least one upper track supporting the upper roller assembly; and at least one lower track supporting the lower roller assembly.

29. The system of claim 28 including means for moving at least one of the upper roller assembly and the lower roller assembly along the upper axis or the lower axis, respectively, between the operation position and the removed position.

30. The system of claim 28 wherein the upper roller assembly rests upon the at least one upper track.

31. A support and actuation system for use with an upper roller assembly having a first rotatably supported cylindrical member extending along an axis, a lower roller assembly having a second rotatably supported cylindrical member extending along the axis, and at least one first interface coupled to one of the upper roller assembly and the lower roller assembly, the support and actuation system comprising:

a frame extending along a longitudinal axis;

at least one second interface coupled to the frame, the at least one second interface configured to interact with the at least one first interface to movably support said one of the upper roller assembly and the lower roller assembly along the axis relative to the other of the upper roller assembly and the lower roller assembly;

an actuator coupled to the frame and configured to move said one of the upper roller assembly and the lower roller assembly in a vertical direction; and at least one third interface extending along a second axis and coupled to the frame, the at least one third interface configured to interact with a fourth interface coupled to the other of the upper roller assembly and the lower roller assembly to movably support the other of the upper roller assembly an the lower roller assembly for movement along the second axis.

32. The support and actuation system of claim 31 including a vertically adjustable stop configured to facilitate positioning of at least one of the upper roller assembly and the lower roller assembly relative to a pass line of a strip passing between the upper roller assembly and the lower roller assembly.

33. A roller assembly for use with a roller system having an actuator and at least one first interface, the roller assembly comprising:

a first bearing block;

a second bearing block;

a cylindrical member rotatably supported between the first bearing block and the second bearing block for rotation about an axis; and at least one second interface coupled to the first bearing block and the second bearing block, the at least one second interface adapted to cooperate with the at least one first interface to facilitate movement of the roller assembly along the axis, wherein the first bearing block and the second bearing block are configured to be releasably coupled to the actuator for lifting the second interface above the first interface.

34. The assembly of claim 33 wherein the at least one first interface includes at least one track and wherein the at least one second interface includes one second interface coupled to the first bearing block and another second interface coupled to the second bearing block, wherein the second interfaces are configured to engage the at least one track to move the roller assembly along the axis.

35. A roller system comprising:

a frame;

an upper roller assembly having a first rotatably supported cylindrical member extending along an upper axis;

a lower roller assembly having a second rotatably supported cylindrical member extending along a lower axis;

means for moving the upper roller assembly along the upper axis relative to the lower roller assembly between an operation position and a removed position; and means for vertically moving one of the upper roller assembly and the lower roller assembly.

36. The system of claim 35 including means for vertically moving the other of the upper roller assembly and the lower roller assembly between a raised position and a lower position.

37. A roller system comprising:

a frame;

an upper roller assembly supported by the frame and including a first rotatably imported cylindrical member;

a lower roller assembly movably supported by the frame below the upper roller assembly and including a second rotatably supported cylindrical member, wherein the first member and the second member are configured to engage opposite sides of a workpiece passing between the first member an the second member; and an actuator configured to move the second cylindrical member between an elevated position in which axial end and an axial midpoint of the second member are raised and a lowered position in which the axial ends and the axial midpoint are lowered, wherein the upper roller assembly and the lower roller assembly are substantially identical to one another so as to be interchangeable with one another.

38. A roller system comprising:

a frame;

an upper roller assembly supported by the frame and including a first rotatably supported cylindrical member;

a lower roller assembly movably supported by the frame below the upper roller assembly and including a second rotatably supported cylindrical member; and an actuator located above the lower roller assembly, wherein the first member and the second member are configured to engage opposite sides of a workpiece passing between the first member and the second member an wherein the actuator is configured to move the second cylindrical member, while the first cylindrical member is vertically stationary, between an elevated position in which axial ends and an axial midpoint of the second member are raised and a lowered position in which th axial ends and the axial midpoint are lowered.

39. A roller system comprising:

a frame;

an upper roller assembly supported by the frame and including a first rotatably supported cylindrical member;

a lower roller assembly movably supported by the frame below the upper roller assembly and including a second rotatably supported cylindrical member, wherein the first member and the second member are configured to engage opposite sides of a workpiece passing between the first member and the second member;

an actuator configured to move the second cylindrical member relative to the first cylindrical member and between an elevated position in which axial ends and an axial midpoint of the second member are raised and a lowered position in which the axial ends of the axial midpoint are lowered; and at least one support configured to movably support the lower roller assembly for movement between an operation position and an at least partially removed position relative to the frame when the lower roller assembly is in the lowered position, wherein the upper roller assembly and the lower roller assembly are substantially identical to one another so as to be interchangeable with one another.

40. A roller system comprising:

a frame;

an upper roller assembly supported by the frame and including a first rotatably supported cylindrical member;

a lower roller assembly movably supported by the frame below the upper roller assembly and including a second rotatably supported cylindrical member, wherein the first member and the second member are configured to engage opposite sides of a workpiece passing between the first member and the second member;

an actuator configured to move the second cylindrical member relative to the first cylindrical member and between an elevated position in which axial ends and an axial midpoint of the second member are raised and a lowered position in which the axial ends of the axial midpoint are lowered;

at least one support configured to movably support the lower roller assembly for movement between an operation position and an at least partially removed position relative to the frame when the lower roller assembly is in the lowered position; and a stop vertically movable between a plurality of positions, wherein the upper roller assembly is vertically movable between a raised position in which the upper roller assembly engages the stop and a lower position.

41. The system of claim 40 including means for retaining the stop at each of the plurality of the positions.

42. The system of claim 40 including a continuous height adjustment mechanism configured to continuously vertically adjust a height of the stop.

43. The system of claim 42 wherein the continuous height adjustment mechanism includes:

a threaded rod supported by the frame; and a wheel threadably engaging the threaded rod and coupled to the stop, whereby rotation of the wheel continuously vertically adjusts a height of the stop along the threaded rod.

44. A support and actuation system for use with an upper roller assembly having a first rotatably supported cylindrical member extending along an axis, a lower roller assembly having a second rotatably supported cylindrical member extending along the axis, and at least one first interface coupled to one of the upper roller assembly and the lower roller assembly, the support and actuation system comprising:

a frame extending along a longitudinal axis;

at least one second interface coupled to the frame, the at least one second interface configured to interact with the at least one first interface to movably support said one of the upper roller assembly and the lower roller assembly along the axis relative to the other of the upper roller assembly and the lower roller assembly;

an actuator coupled to the frame and configured to move said one of the upper roller assembly and the lower roller assembly in a vertical direction; and a vertically adjustable stop configured to facilitate positioning of at least one of the upper roller assembly and the lower roller assembly relative to a pass line of a strip passing between the upper roller assembly and the lower roller assembly.

* * * * *

UNITED STATES PATENT AND TRADEMARK OFFICE

CERTIFICATE OF CORRECTION

PATENT NO. : 6,786,144 B2
DATED : September 7, 2004
INVENTOR(S) : Thomas E. Williams It is certified that error appears in the above-identified patent and that said Letters Patent is hereby corrected as shown below:

Column 16,
Line 61, please add -- are -- after "and the second member."

Column 17,
Line 29, please add -- a -- before "track."

Column 18,
Line 35, please replace "surface" with -- surfaces --.
Line 52, please replace "side" with -- sides --.

Column 19,
Line 24, please replace "an" with -- and --.

Column 20,
Line 8, please replace "imported" with -- supported --.
Line 14, please replace "an" with -- and --.
Line 32, the paragraph should be indented.
Line 35, please replace "an" with -- and --.
Line 40, please replace "th" with -- the --.

Signed and Sealed this

Fifteenth Day of March, 2005

JON W. DUDAS
*Director of the United States Patent and Trademark Office*